US007999162B2

(12) United States Patent
Izutani et al.

(10) Patent No.: US 7,999,162 B2
(45) Date of Patent: Aug. 16, 2011

(54) MOVABLE PART FIRMLY EQUIPPED WITH BALANCE WEIGHT, MUSICAL INSTRUMENT AND METHOD OF ASSEMBLING BALANCE WEIGHT THEREIN

(75) Inventors: Hitoshi Izutani, Shizuoka-ken (JP); Noboru Yamashita, Shizuoka-ken (JP); Satoshi Inoue, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 11/373,235

(22) Filed: Mar. 13, 2006

(65) Prior Publication Data

US 2006/0207404 A1 Sep. 21, 2006

(30) Foreign Application Priority Data

Mar. 15, 2005 (JP) ..... 2005-072226
Mar. 25, 2005 (JP) ..... 2005-087558

(51) Int. Cl.
*G10C 3/12* (2006.01)

(52) U.S. Cl. ..... 84/25; 84/174; 84/423 R; 84/433; 84/439

(58) Field of Classification Search ..... 84/13, 16–30, 84/33, 57, 60, 61, 174, 187, 188, 423 R, 433–441
See application file for complete search history.

(56) References Cited

U.S. PATENT DOCUMENTS 2,117,832 A 5/1938 Wellner
2,393,923 A 1/1946 Miller
3,171,321 A 3/1965 Fischer
3,478,641 A 11/1969 Dohmeier
3,654,831 A * 4/1972 Grilli et al. ..... 84/435
3,956,803 A 5/1976 Leitner
4,827,609 A 5/1989 Kawecki
5,142,834 A 9/1992 Laclave et al.
5,158,003 A * 10/1992 Lee ..... 84/439
5,346,349 A 9/1994 Giovannetti et al.
5,368,427 A 11/1994 Pfaffinger
5,468,109 A 11/1995 Ferrari et al.
5,498,108 A 3/1996 Frandberg
5,585,582 A * 12/1996 Stanwood ..... 84/432
5,591,927 A 1/1997 Kawamura et al.
5,704,750 A * 1/1998 Bartos et al. ..... 411/411
5,897,278 A 4/1999 Frattarola
(Continued)

FOREIGN PATENT DOCUMENTS

JP 2002-162960 6/2002
(Continued)

*Primary Examiner* — Elvin G Enad
*Assistant Examiner* — Christopher Uhlir
(74) *Attorney, Agent, or Firm* — Dickstein Shapiro LLP

(57) ABSTRACT

Keys of a piano are depressed against the total weight of associated action units and hammers so that balance weight pieces are embedded in the front portion of each key; since the wood bar of the key is expandable and shrinkable due to the conditions of the environment, the weight pieces are liable to come loose; the balance weight piece is formed with ridges and valleys repeated at least 7 times at fine pitches equal to or less than 2 millimeters, and the maximum diameter of the ridges is slightly longer than an inner diameter of a hole formed in the wood bar; while the balance weight piece is being pressed into the hole, the ridges make the inner surface portion elastically deformed; when the balance weight piece reaches the target position, the inner surface portion penetrates into the valleys so that the balance weight piece is lodged therein.

18 Claims, 15 Drawing Sheets

U.S. PATENT DOCUMENTS

| | | | | |
|---|---|---|---|---|
| 5,897,401 | A | 4/1999 | Fili et al. | |
| 6,109,578 | A | 8/2000 | Guthrie et al. | |
| 6,116,836 | A | 9/2000 | Long, Sr. | |
| 6,119,993 | A | 9/2000 | Youngblood et al. | |
| 6,296,430 | B1 | 10/2001 | Fischer | |
| 6,406,214 | B1 | 6/2002 | Chene | |
| 6,435,790 | B1 | 8/2002 | Ichikawa | |
| 6,531,651 | B2 * | 3/2003 | Kanemitsu et al. | 84/433 |
| 6,540,463 | B2 | 4/2003 | Ward | |
| 6,568,893 | B2 | 5/2003 | LeVey et al. | |
| 6,575,682 | B1 | 6/2003 | Dohm et al. | |
| 6,676,352 | B2 | 1/2004 | Chen-Chi et al. | |
| 6,679,646 | B2 | 1/2004 | Quardt et al. | |
| 6,779,232 | B2 | 8/2004 | Cerul | |
| 6,935,527 | B1 | 8/2005 | Brock | |
| 7,067,730 | B2 | 6/2006 | Inoue et al. | |
| 2001/0036386 | A1 | 11/2001 | Chene | |
| 2003/0047061 | A1 * | 3/2003 | Kugimoto et al. | 84/433 |
| 2003/0077144 | A1 | 4/2003 | Perrot | |
| 2003/0084776 | A1 * | 5/2003 | Inoue | 84/174 |
| 2004/0123728 | A1 | 7/2004 | Inoue | |
| 2004/0163526 | A1 | 8/2004 | Muramatsu | |
| 2004/0221711 | A1 | 11/2004 | Kato et al. | |
| 2005/0002753 | A1 | 1/2005 | Haas | |
| 2005/0125818 | A1 | 6/2005 | Ito et al. | |
| 2005/0211048 | A1 | 9/2005 | Fujiwara | |

FOREIGN PATENT DOCUMENTS

| | | |
|---|---|---|
| JP | 2002-265793 | 9/2002 |
| JP | 2003-150148 | 5/2003 |
| JP | 2003-162279 | 6/2003 |

* cited by examiner

MOVABLE PART FIRMLY EQUIPPED WITH BALANCE WEIGHT, MUSICAL INSTRUMENT AND METHOD OF ASSEMBLING BALANCE WEIGHT THEREIN

FIELD OF THE INVENTION

This invention relates to a movable part of a keyboard such as keys and, more particularly, to a movable component part of a keyboard equipped with balance weight, a keyboard musical instrument having the keyboard and a method of assembling the balance weight into the movable component part.

DESCRIPTION OF THE RELATED ART

A piano is a typical example of the keyboard musical instrument. Black keys and white keys are arranged on a balance rail in such a manner as to pitch up and down, and are respectively linked with the action units for driving the hammers to rotate. The total weight of the action unit and hammer is exerted on the rear portion of the associated black/white key so that the pianist depresses the front portion of the black/white key against the total weight.

The moment due to the action unit and hammer is not small, and makes the key action less prompt. In order to decrease the moment due to the action unit and hammer, balance weight pieces are embedded in the wooden bars, which are colored in white and black, and the balance weight pieces produce the counter moment against the moment due to the action unit and hammer.

The balance weight pieces are usually inserted into holes formed in the wooden bars, and are made fit in the holes through plastic deformation. In order to make the balance weight pieces fitted in the holes, it is desirable to make the balance weight pieces of soft heavy material such as lead. However, the lead pollutes the environment. Other heavy metal is not so soft as the lead, and the balance weight pieces made of hard heavy metal are liable to drop off.

Various countermeasures have been proposed. One of the countermeasures is disclosed in Japanese Patent Application laid-open No. 2003-150148. The prior art balance weight piece disclosed in the Japanese Patent Application laid-open has a generally column shape, and annular ridges are formed on the peripheral surface of the column-shaped body at intervals in the direction of the center axis. Each of the annular ridges has a rear ring surface parallel to the rear end surface of the column-shaped body and a front ring surface inclined toward the rear end surface.

The prior art balance weight piece is assembled with the wooden bar as follows. Cylindrical through-holes are formed in the wooden bar, and are open on the side surfaces. The cylindrical through-holes have the inner diameter slightly less than the outer diameter of the prior art balance weight pieces. Each of the prior art balance weight pieces is assigned to one of the cylindrical through-holes.

A worker directs the front end surface of the prior art balance weight piece to the opening of the cylindrical through-hole, and aligns the center axis of the prior art balance weight piece with the center axis of the cylindrical through-hole. The worker presses the prior art balance weight piece into the cylindrical through-hole. While the prior art balance weight piece is advancing toward the other opening of the cylindrical through-hole, the front ring surfaces bite into the inner surface portions of the wooden bar so as to prevent the prior art balance weight piece from dropping off.

However, the annular ridges can not keep the prior art balance weight pieces stable in the cylindrical through-holes. This is because of the fact that the prior art balance weight pieces cut out the inner surface portions from the wooden bar with the annular ridges while the worker was pushing the prior art balance weight piece into the cylindrical through-holes. In other words, the cylindrical through-holes were enlarged in inner diameter during the assembling work so that some annular ridges slightly bite into the wooden bar. The wooden bar has been dried after the assemblage so that the annular ridges come loose. As a result, the prior art balance weight pieces chatter in the cylindrical through-holes, and some balance weight pieces drop off from the wooden bar.

SUMMARY OF THE INVENTION

It is therefore an important object of the present invention to provide a movable component part of a musical instrument from which balance weight pieces are less liable to come loose.

It is also an important object of the present invention to provide a keyboard musical instrument, which has the movable component parts.

It is another important object of the present invention to provide a method for firmly fitting balance weight pieces into bars of movable component parts of a musical instrument.

To accomplish the object, the present invention proposes to elastically lodge a weight piece in an elastically deformable inner surface portion of a body.

In accordance with one aspect of the present invention, there is provided a movable part of a musical instrument comprising a body formed with at least one hollow space defined by an elastically deformable inner surface portion, and at least one weight piece formed with a unit shape repeated at least seven times on a surface of the aforesaid at least one weight piece at fine pitches equal to or less than 2 millimeters and defining clearance and inserted into the hollow space so as to permit the elastically deformable inner surface portion elastically to penetrate into the clearance.

In accordance with another aspect of the present invention, there is provided a musical instrument comprising plural component parts for producing sound, at least one of which is movable in a sequence to produce the sound, and the aforesaid at least one of the plural component parts include a body formed with at least one hollow space defined by an elastically deformable inner surface portion and at least one weight piece formed with a unit shape repeated at least seven times on a surface of the aforesaid at least one weight piece at fine pitches equal to or less than 2 millimeters and defining clearance and inserted into the hollow space so as to permit the elastically deformable inner surface portion elastically to penetrate into the clearance.

In accordance withy yet another aspect of the present invention, there is provided a method of assembling a weight piece in a movable part of a musical instrument comprising the steps of a) preparing a body formed with at least one hollow space defined by an elastically deformable inner surface portion and at least one weight piece formed with a unit shape repeated at least seven times on a surface of the aforesaid at least one weight piece at fine pitches equal to or less than 2 millimeters and defining clearance, b) inserting the aforesaid at least one weight piece into the aforesaid at least one hollow space so as to make the inner surface portion elastically deformed by the unit shape, and c) stopping the aforesaid at least one weight piece at a certain position in the aforesaid at least one hollow space so that the elastically deformed portion of the inner surface portion penetrates into the clearance.

BRIEF DESCRIPTION OF THE DRAWINGS

The features and advantages of the movable component part, keyboard musical instrument and method will be more clearly understood from the following description taken in conjunction with the accompanying drawings, in which.

DESCRIPTION OF THE PREFERRED EMBODIMENTS

In the following description, term "front" is indicative of a position closer to a player, who is sitting on a stool for fingering, than a position modified with term "rear", and a line drawn between a front position and a corresponding rear position extends in a fore-and-aft direction, and a lateral direction crosses the fore-and-aft direction at right angle. An up-and-down direction is normal to a plane defined by the fore-and-aft direction and lateral direction.

Figure 1:
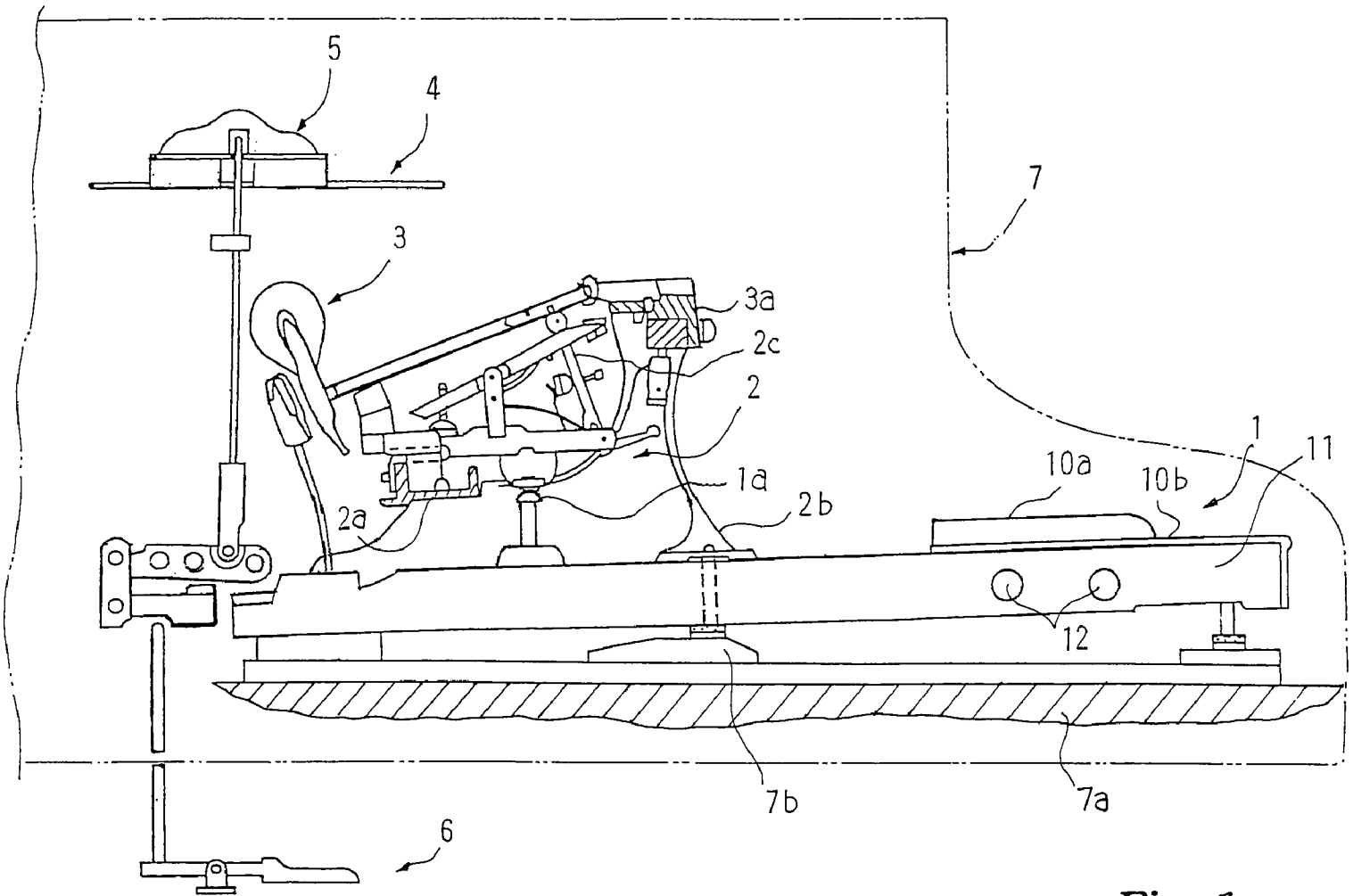
FIG. 1 is a schematic side view showing the structure of a keyboard musical instrument according to the present invention.

Referring to FIG. 1 of the drawings, a grand piano largely comprises a keyboard 1, action units 2, hammers 3, strings 4, dampers 5, a pedal system 6 and a piano cabinet 7. The keyboard 1 is mounted on a front portion of a key bed 7*a*, which define the bottom of the piano cabinet 7, and includes black keys 10*a* and white keys 10*b*. The black keys 10*a* and white keys 10*b* are laid on a well-known pattern, and are inclinable toward the key bed 7*a*. A long bar 11 form a substantial part of each of the black and white keys 10*a*/11*b*, and is formed of resiliently deformable material such as, for example, wood or synthetic resin.

When a player exerts force on the front portions of the black keys 10*a* and front portions of the white keys 10*b*, the front portions are sunk toward the key bed 7*a*. In other words, the black and white keys 10*a* and 10*b* travel on their trajectories from rest positions to end positions. On the other hand, when the force is removed from the front portions, the front portions are raised due to the total weight of the action units 2 and hammers 3. In detail, a balance rail 7*b* laterally extends on the key bed 7*a*. The balance rail 7*b* offers fulcrums to the black and white keys 10*a* and 10*b* so that the front portions of black and white keys 10*a*/10*b* pitch up and down. The action units 2 are rotatably supported over the rear portions of the black and white keys 10*a*/10*b* by a whippen rail 2*a*, which in turn is supported by action brackets 2*b* on the key bed 7*a*, and are connected to the black and white keys 10*a*/10*b* through capstan buttons 1*a*. Each of the action units 2 exerts the weight on the rear portion of the associated black/white key 10*a*/10*b*. The hammers 3 are supported by a shank flange rail 3*a*, which in turn is supported by the action brackets 2*b*, and are rest on the top surfaces of jacks 2*c*, which form parts of the action units 2. Each of the hammers 3 exerts the weight on the associated action unit 2. Thus, the total weight of action units 2 and hammers 3 are exerted on the rear portions of the associated black and white keys 10*a*/10*b*.

The total weight of action unit 2 and hammer 3 make the front portions of the black and white keys 10*a*/10*b* float over the key bed 7*a* as shown in FIG. 1. The total weight of action unit 2 and hammer 3 produces moment about the balance rail 7*b*. The moment is too large for a player quickly to give rise to the key motion. Balance weight pieces 12 are embedded in the front portions of the black and white keys 10*a*/10*b* so as to cancel part of the moment. For this reason, a player can quickly give rise to the key motion.

In this instance, a pair of balance weight pieces 12 laterally extends in through-holes 11*a*/11*b*, which are formed in the bar 11 of the black/white key 10*a*/10*b*, and the balance weight pieces 12 are exposed on the side surfaces of the bars 11. The balance weight pieces 12 are made of harmless metal such as, for example, iron, tungsten or copper. However, lead is not used for the balance weight pieces 12 because of an origin of the environmental pollution. It is desirable that the metal has large specific weight, because compact balance weight pieces are easily embedded in the bar 11. Alloy such as, for example, brace is available for the balance weight pieces 12. Sintered metal and metallic powder-containing synthetic resin are also available for the balance weight pieces 12. In case where the balance weight pieces 12 are formed of the powder-containing synthetic resin, the powder-containing synthetic resin is different in rigidity from the resiliently deformable material.

Though not shown in FIG. 1, plural ridges are alternated with plural valleys on the peripheral surface of each balance weight piece 12 at fine pitches. The maximum diameter of the ridges is slightly longer than the inner diameter of the through-holes 11*a* and 11*b*. The balance weight pieces 12 are pushed into the through-holes 11*a* and 11*b* in the direction parallel to the center axes of the through-holes 11*a* and 11*b*. The balance weight piece 12 advances deep into the through-hole 11*a* or 11*b* without scrapping off the inner surface portion, which defines the through-hole 11*a* or 11*b*. The inner surface portion is elastically deformed by the ridges. When the balance weight piece 12 reaches the target position in the through-hole 11*a* or 11*b*, the inner surface portion elastically penetrates into the valleys, and exerts elastic force on the ridges. As a result, the balance weight piece 12 is lodged in the inner surface portion, and does not come loose.

The balance weight pieces 12 may be further moved in the through-holes 11*a* and 11*b* in certain directions different from the directions parallel to the center axes. While the ridges are advancing into the through-holes, the ridges, which are repeated at the fine pitches, make the inner surface portions of the bar 11 resiliently deformed, and the resiliently deformed portions expand in the valleys. In other words, the ridges and valleys make the inner surface, which defines the through-hole, waved. However, the inner surface portions are not scraped off. Thus, the waved inner surface portions exert the resilient force on the ridges, and prevent the balance weight pieces 12 from coming loose. If the balance weight pieces 12 are moved in the certain direction, the inner surface portions keep the balance weight pieces 12 more stable in the through-holes 11*a* and 11*b*. However, the motion in the certain direction is avoidable, because the balance weight pieces 12 have been already lodged in the inner surface portions.

The present inventors confirmed through experiments that the fine pitches were to be equal to or less than 2 millimeters, and the unit shape, i.e., the combination of a ridge and a valley was to be repeated at least seven times. The diameter of the through-holes 11*a* and 11*b* was to be shorter than the maximum diameter of the unit shape by 1 millimeter of less. However, it was desirable that the diameter of the through-holes 11*a* and 11*b* was shorter than the maximum diameter of the unit shape by at least 0.2 millimeter. In short, the difference in diameter between the unit shape and the hole was to be fallen within the range between 0.2 millimeter and 1.0 millimeter. The minimum distance between the tops of ridges and the bottoms of valleys was 0.2 millimeter. Then, the ridges were smoothly lodged in the inner surface portions defining the through-holes 11*a* and 11*b* without scrapping. In case where the ridges were rounded, the inner surface portion was perfectly prevented from the scraping with the ridges. A sample was designed to have the unit shape repeated ten times on the peripheral surface of the body of 10 millimeters, and the body of 10 millimeters was lodged in the inner surface portion. Then, the sample could resist against large external force, which was much larger than reference force presumed during the long service-time, in the direction to push-in and in the direction to pull-out. Thus, the balance weight pieces 12 were featured by the fine pitches and repetition of unit shape.

The strings 4 are stretched over the hammers 3, and are struck with the hammers 3 at the end of free rotation. Then, the strings 4 vibrate, and acoustic piano tones are produced through the vibrating strings 4. The dampers 5 are provided in the space over the rear portions of the black/white keys 10*a*/10*b*, and are selectively driven for up-and-down motion by the associated black and white keys 10*a*/10*b*. While the black and white keys 10*a*/10*b* are staying at the rest positions, the dampers 5 are held in contact with the strings 4, and each damper 5 prevents the associated string 4 from resonance with vibrating strings 4. The black and white keys 10*a*/10*b* are lifted upwardly by the associated black and white keys 10*a*/10*b* on the way to the end positions so as to be spaced from the strings 4. While the black and white keys 10*a*/10*b* keeps the associated dampers 5 spaced from the strings 4, the strings 4 become vibratory so that the hammers 3 give rise to the vibrations of the associated strings 4 through the collision.

The pedal system 6 includes at least a damper pedal and soft pedal. When a player steps on the damper pedal, the pedal system 6 keeps all the dampers 5 spaced from the strings 4 so that the acoustic piano tones are prolonged. On the other hand, the soft pedal makes the keyboard 1 laterally slide with respect to the strings 4 so that the number of strings 4 to be struck with the hammers 3 are reduced. As a result, the volume of acoustic piano tones is lessened.

As will be understood from the foregoing description, the balance weight piece 12 is formed with the ridges repeated at the fine pitches in accordance with the present invention, and the ridges, which bite into the bar 11, prevent the balance weight piece 12 from coming loose. For this reason, the balance weight pieces neither chatter in the bar, not drop off.

First Embodiment

Figure 2:
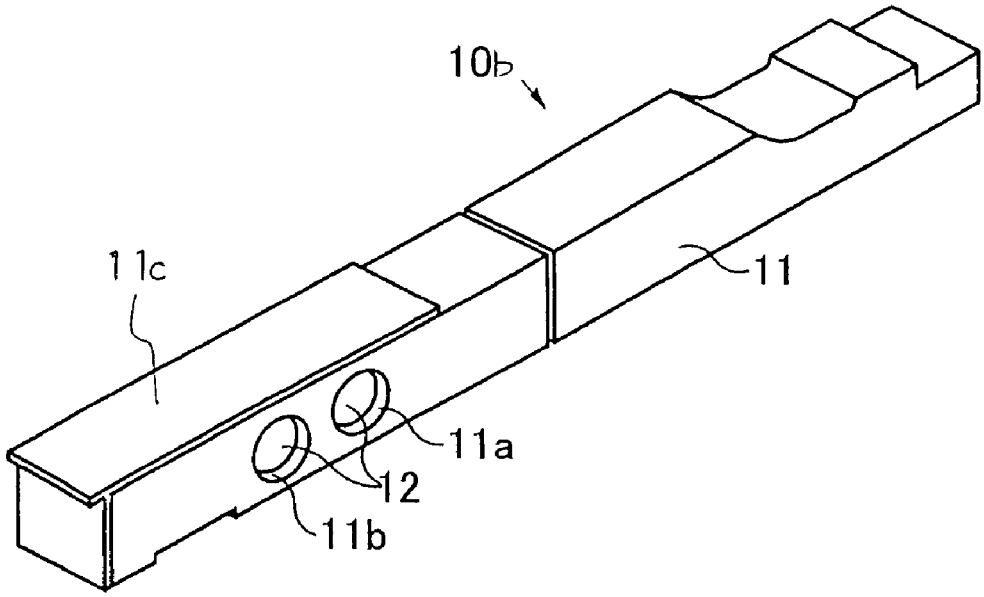
FIG. 2 is a perspective view showing the configuration of a white key incorporated in the keyboard musical instrument.

Referring to FIG. 2 of the drawings, one of the white keys 10*b* includes the bar 11, balance weight pieces 12 and a covering plate 11*c*. In this instance, the bar 11 is made of wood, and has a longitudinal direction, which is in parallel to the fore-and-aft direction after the installation into the grand piano. Cylindrical holes 11*a* and 11*b* are formed in the bar 11, and have center axes crossing the longitudinal direction at right angle. The cylindrical holes 11*a* and 11*b* are substantially in parallel to one another. The cylindrical holes 11*a* and 11*b* are open on both side surfaces of the bar 11, and the balance weight pieces 12 are provided in the cylindrical holes 11*a* and 11*b*.

The balance weight pieces 12 are made of copper, and are respectively embedded in the cylindrical holes 11*a* and 11*b* in stable. The balance weight pieces 12 are hereinlater described in detail. The covering plate 11*c* is colored in white, and the upper surface of the front portion and front end surface are covered with the white covering plate 11*c*.

Figure 3:
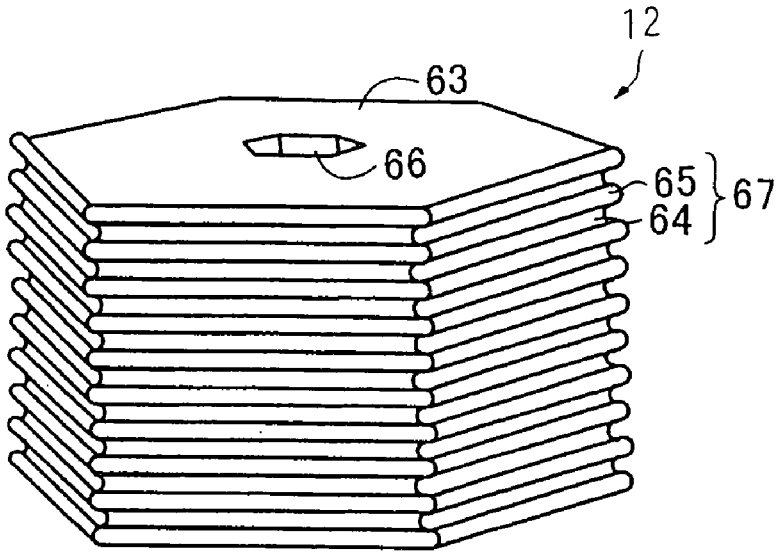
FIG. 3 is a perspective view showing the configuration of a balance weight piece embedded in the white key.

Turning to FIG. 3, the balance weight piece 12 has a generally hexagonal column shape. The generally hexagonal column has a rolling periphery, and has a center axis between the end surfaces. A hexagonal through-hole 66 is formed in the generally hexagonal column. The hexagonal through-hole 66 extends in parallel to the center axis, and is open on both end surfaces 63.

The generally hexagonal column is assumed to have a quasi-peripheral surface at a certain diameter between the maximum diameter and the minimum diameter. Nine valleys 64 and ten ridges 65 take place on the quasi-peripheral surface. The ridges 65 are like a hexagonal plate so that each ridge 65 has six corners. However, the portion between the ridges 65 is either hexagonal or a ring-shaped. Each diagonal line between the opposite corners is slightly longer than the diameter of the cylindrical holes 11*a* and 11*b*.

Figure 4:
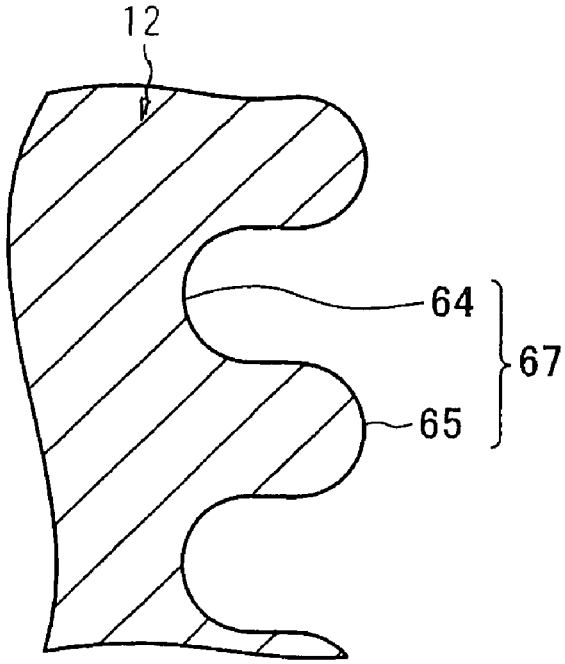
FIG. 4 is a cross sectional view showing the cross section of ridges and valleys of the balance weight piece.

The ten ridges 65 are altered with the nine valleys 64, and each of the nine ridges 65 and the valley 64 contiguous thereto form a unit shape 67. In this instance, the unit shape 67 is nine times repeated at pitches of 1.05 millimeters in the direction of the center axis. In other words, the peaks of ridges 65 are spaced from one another by 1.05 millimeters, and the bottoms of valleys 64 are also spaced from one another by 1.05 millimeters. The distance between the peaks and bottoms is adjusted to 0.52 millimeter. As will be better seen in FIG. 4, the ridges 65 are rounded, and the radius of curvature is 0.26 millimeter. Similarly, the valleys 64 have a semi-circular cross section, and the radius of curvature is also 0.26 millimeter.

Figure 5:
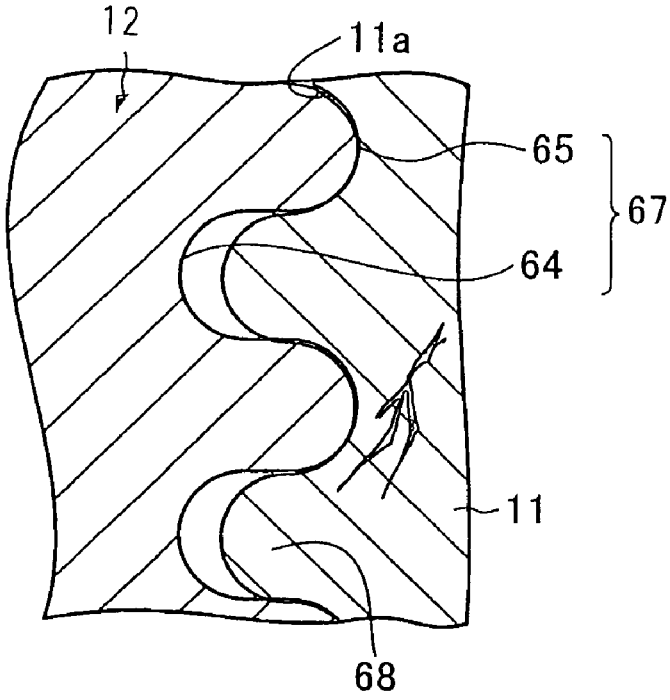
FIG. 5 is a cross sectional view showing the cross section of the ridges, valleys and a waved inner surface portion of a bar.

The balance weight pieces 12 are embedded in the bar 11 as follows. First, a worker aligns the center axis of the balance weight piece 12 with the center axis of the cylindrical hole 11*a* or 11*b*, and pushes the balance weight piece 12 into the cylindrical hole 11*a* or 1*b*. While the balance weight piece 12 is advancing into the cylindrical hole 11*a* or 11*b*, the ridges 65 make the inner surface portion of the bar 11 resiliently deformed, and the resiliently deformed portion expands into the valleys 64. Thus, the inner surface portion is waved as shown in FIG. 5, and the waved surface portion keeps the balance weight piece 12 stable in the cylindrical hole 11*a* or 11*b*. Since the ridges 65 are rounded and spaced at the fine pitches, the inner surface portion is not scraped off, and the resilient force is surely exerted on the ridges 65.

In this instance, the worker inserts a tool, which has a hexagonal cross section, into the hexagonal hole 66, and turns the balance weight piece 12 in the cylindrical hole 11*a* or 11*b* about the center axis. The rounded ridges 65 does not make the inner surface portion scraped off. As a result, the corners of the ridges 65 give rise to the resilient deformation of the inner surface portion so as to bite thereinto. As a result, the balance weight piece 12 is firmly grasped by the inner surface portion of the bar 11. Even if the worker completes the work without turning the balance weight piece 12, the waved inner surface portion keeps the balance weight piece 12 stable in the cylindrical hole 11*a* or 11*b*.

As will be understood from the foregoing description, the nine ridges 65 are arranged at the fine pitches less than 2 millimeters so that the inner surface portions are resiliently deformed with the ridges 65 during the insertion into the cylindrical holes 11*a* and 11*b*. The waved inner surface portions exert the resilient force on the ridges 65, and expand into the valleys so as to pinch the ridges 65. Thus, the balance weight pieces 12 do not come loose in the cylindrical holes 11*a* and 11*b*.

Modifications of the First Embodiment

Figure 6:
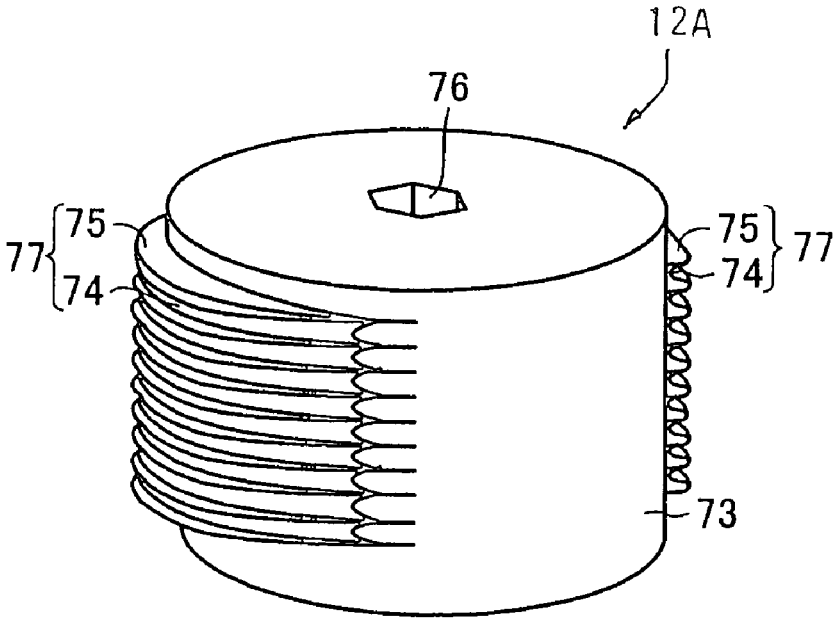
FIG. 6 is a perspective view showing the first modification of the balance weight piece.

FIG. 6 shows the first modification 12A of the balance weight piece 12. The balance weight piece 12A has a center column 73 and ten pairs of ridges 75 formed on the peripheral surface of the center column 73, and a center axis extends between both end surfaces. A hexagonal hole 76 is formed in the center column 73, and extends in the direction of the center axis.

The ten pairs of ridges 75 are spaced from one another at fine pitches equal to those of the ridges 65 in the direction of the center axis, and the ridges 75 of each pair is spaced in the circumferential direction of the center column 73 by 180 degrees. Each of the ridges 75 is reduced in width toward both sides, and are rounded as similar to the ridges 65. The rounded cross section has a radius of curvature equal to that of the cross section of the ridge 65. However the ridges 75 of each pair are disconnected from one another, and the peripheral surface of the center column 73 is exposed therebetween. Gaps 74 take place among the ridges 75, and the maximum depth of gaps 74 is equal to the distance between the top of the ridge 65 and the bottom of the valley 64.

Each ridge 75 and associated gap 74 form a unit shape 77. In this instance, the unit shape 77 is repeated twenty times on the peripheral surface of the center column 73.

The balance weight pieces 12A are embedded in a bar of a black key or a bar of a white key as follows. Holes are formed in the bar, and have an elliptical cross section. The major axis of the elliptical cross section is slightly longer than the maximum distance between the ridges of each pair.

A worker aligns the balance weight piece 12A with the hole, and pushes the balance weight piece 12A into the hole. While the balance weight piece 12A is advancing into the hole, the ridges 75 make the inner surface portion resiliently deformed, and the resiliently deformed portions expand in the gaps 74. Thus, the inner surface portion is waved. The waved inner surface portion exerts the resilient force on the ridges 75, and pinches the ridges 75 between the expanding portions in the gaps 74.

In this instance, the worker inserts a tool into the hexagonal hole 76, and turns the balance weight piece 12A about the center axis in the hole. As a result, the ridges 75 bite into the inner surface portion so that the inner surface portion keeps the balance weight piece in more stable.

The balance weight piece 12A achieves all the advantages of the first embodiment by virtue of the fine pitches equal to or less than 2 millimeters and repetition of unit shape equal to or greater than seven times.

Figure 7:
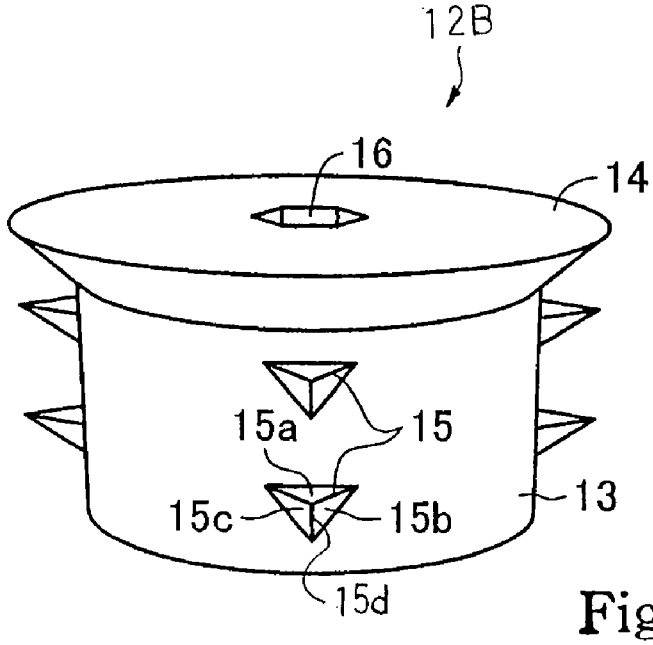
FIG. 7 is a perspective view showing the second modification of the balance weight piece.

The second modification to sixth modification are featured by the motion after the insertion into the holes. FIG. 7 shows the second modification, 12B. The balance weight piece 12B is made of copper, and includes a center column 13, a head 14 and eight projections 15. The center column 13, head 15 and projections 15 are formed in a unitary structure. The center column 13 is approximately equal in diameter to the diameter of the cylindrical holes 11*a* and 11*b*. However, it is admittable to have the diameter slightly shorter than the diameter of the cylindrical holes 11*a*/11*b* in so far as the projections 15, which are spaced from one another by 180 degrees, have the peaks, the distance therebetween is longer than the diameter of the cylindrical holes 11*a*/11*b*.

The head 14 is shaped in a frustum of cone, and has a diameter greater than the diameter of the center column 13.

The centerline of the center column 13 is aligned with the centerline of the head 14, and the peripheral surface of the head 14 is tapered so as to be merged with the peripheral surface of the center column 13. The head 14 has the diameter longer than the diameter of the cylindrical holes 11*a*/11*b*.

A hexagonal hole 16 extends along the centerlines, and is open on the top surface of the head 14. The eight projections 15 form two rows, and the four projections 15 of each row are spaced from one another in the circumferential direction by 90 degrees, and the four projections 15 of one of the rows are respectively spaced from the four projections 15 of the other row in directions parallel to the centerlines. Each of the projections 15 is shaped in a triangular pyramid, and, accordingly, has three peripheral surfaces 15*a*, 15*b* and 15*c*. Although the peripheral surface 15*a* is directed to the tapered peripheral surface of the head 14, the other two peripheral surfaces 15*b* and 15*c* form an edge 15*d*, which is not in any twisted relation with the centerline of the column 13.

Figure 8:
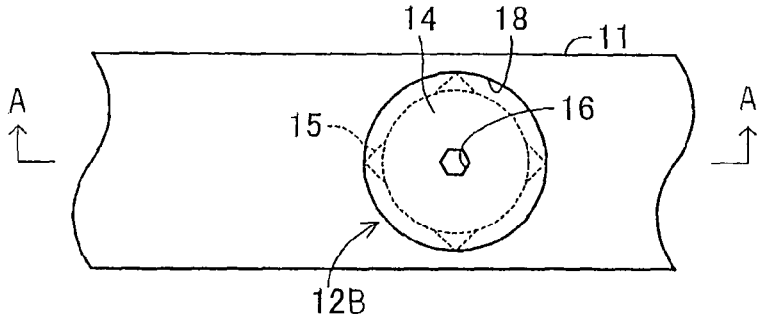
FIG. 8 is a side view showing the balance weight piece pushed into the key.
Figure 9:
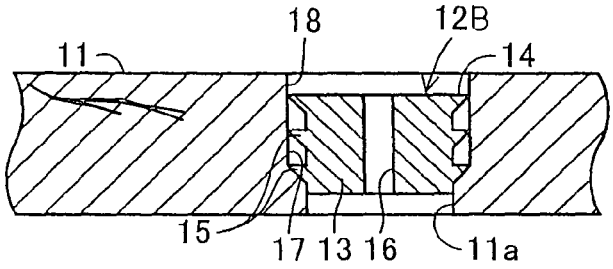
FIG. 9 is a cross sectional view taken along line A-A of FIG. 8 and showing the partially enlarged hole and the balance weight piece.

The balance weight pieces 12B are embedded in the cylindrical holes 11*a* and 11*b* as follows. First, a worker directs the end surface of the center column 13 to the side surface of the bar 11, and aligns the centerline of the column 13 with the center axis of the cylindrical hole 11*a* or 11*b*. The worker presses the balance weight piece 12B into the cylindrical hole 11*a* or 11*b* with a punch and a hammer. While the balance weight piece 12B is advancing into the cylindrical hole 11*a* or 11*b*, the inner surface portion of the bar 11 is scrapped off so that four grooves 17 are formed as shown in FIGS. 8 and 9. When the head 14 reaches the entrance of the cylindrical hole 11*a* or 11*b*, the worker further exerts force on the head 14 so that the balance weight piece 12B is pressed into the cylindrical hole 11*a* or 11*b*. The head 14 makes the entrance widened as indicated by reference numeral 18 in FIG. 9.

Figure 10:
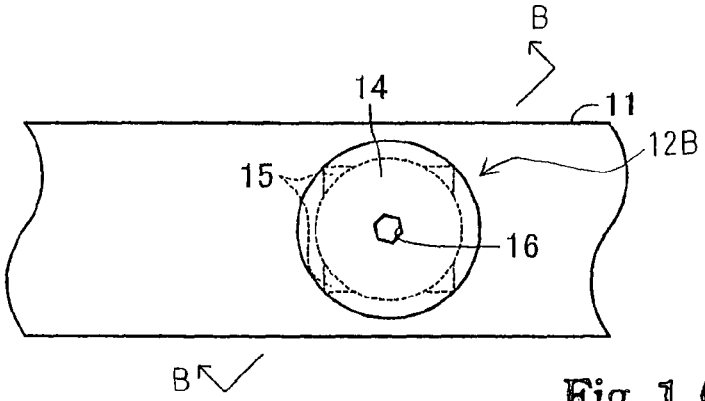
FIG. 10 is a side view showing the balance weight piece after being turned in the hole.
Figure 11:
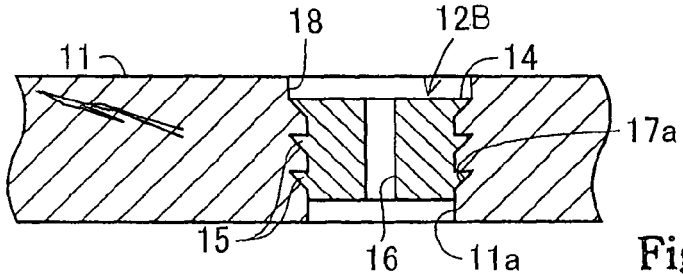
FIG. 11 is a cross sectional view taken along line B-B of FIG. 10, and showing projections biting into the bar.

Subsequently, the worker inserts a hexagonal tool (not shown) into the hexagonal hole 16, and turns the hexagonal tool together with the balance weight piece 12B. While the worker is turning the balance weight piece 12B, the inner surface portion is further scrapped off with the projections 15, and the projections 15 are offset from the grooves 17. In other words, the projections 15 bite into the inner surface portion as shown in FIGS. 10 and 11. In this situation, even if force is exerted on the balance weight piece 12B in the direction to pull out the balance weight piece 12B from the cylindrical hole 11*a* or 11*b*, the peripheral surfaces 15*a* are pinched between the inner surface portions which defines circumferential grooves 17*a* so that the balance weight piece 12B is hardly dropped out.

As will be understood, the balance weight piece 12B is rotated about the centerline thereof in the cylindrical hole 11*a*/11*b* so that the projections 15 are offset from the grooves 17. The inner walls, which define the circumferential grooves 17*a*, prevent the projections 15 from the motion in the direction of the center axis of the cylindrical holes 11*a*/11*b*. The balance weight pieces 12B do not come loose. Thus, the balance weight pieces 12B neither chatter in the cylindrical holes 11*a* and 11*b* nor drop off.

Figure 12:
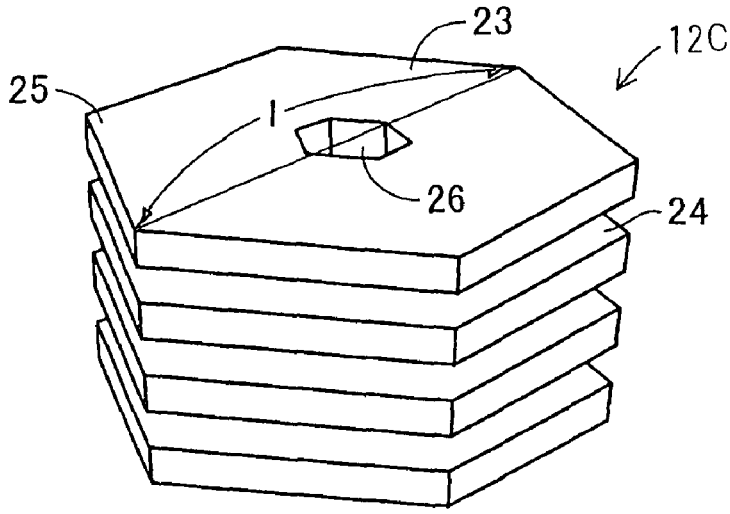
FIG. 12 is a perspective view showing the third modification of the balance weight piece.

FIG. 12 shows the third modification 12C. The balance weight piece 12C is made of copper, and is shaped in a generally hexagonal column. Three circumferential grooves 24 are formed in the hexagonal column at intervals, and the circumferential grooves 24 make four hexagonal plates 23 spaced from one another. Each of the four hexagonal plates 23 have six corners 25, with which the inner surface portion of the bar 11 are scrapped off. A hexagonal hole 26 is formed along the centerline of the hexagonal column, and is open on both end surfaces.

The balance weight piece 12C is embedded in a wooden bar 21 of a key, which is similar to the black/white key 11. A cylindrical hole 21 a extends in the direction of the width of the bar 21, and is open on the side surfaces of the bar 21. The diagonal line 1 of the hexagonal plates 23 is slightly longer than the diameter of the cylindrical hole 21*a*.

Figure 13:
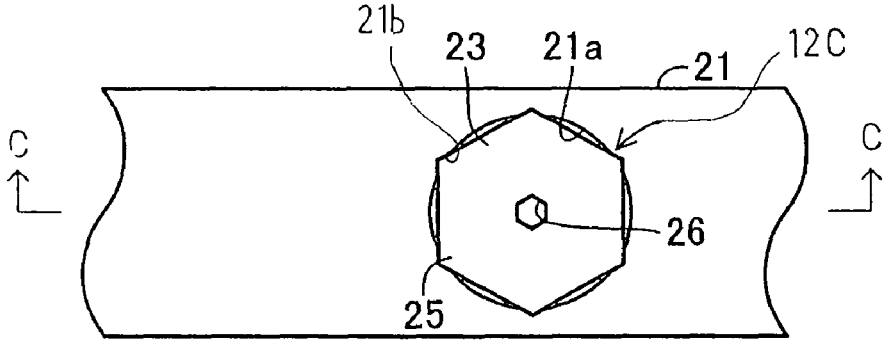
FIG. 13 is a side view showing the balance weight piece pressed into a bar.
Figure 14:
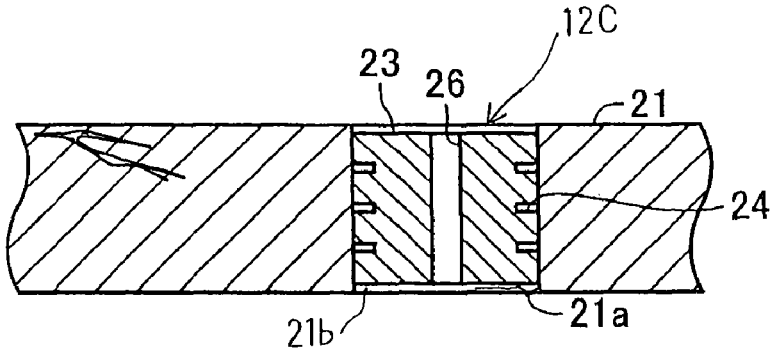
FIG. 14 is a cross sectional view taken along line C-C of FIG. 13 and showing the balance weight piece pressed into the bar.

The balance weight piece 12C is embedded in the cylindrical hole 21*a* as follows. First, a worker aligns the balance weight piece 12C with the cylindrical hole 21*a*, and presses the balance weight piece 12C into the cylindrical hole 21*a* with a hammer (not shown). While the balance weight piece 12C is advancing into the cylindrical hole 21*a*, the inner surface portion is scrapped off with the corners 25, and six grooves 21*b* are formed in the inner surface portion as shown in FIGS. 13 and 14.

Figure 15:
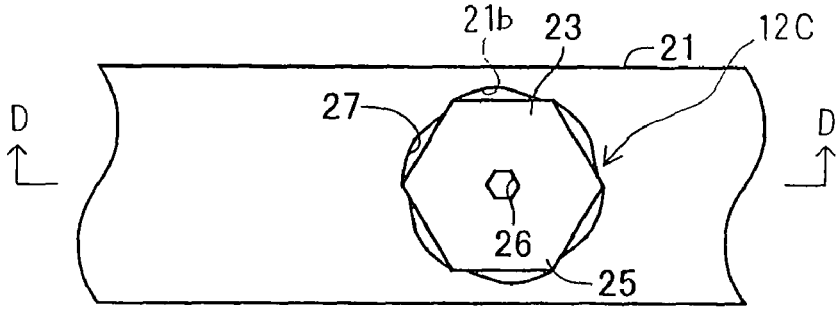
FIG. 15 is a side view showing the balance weight pieces after being turned in the hole.
Figure 16:
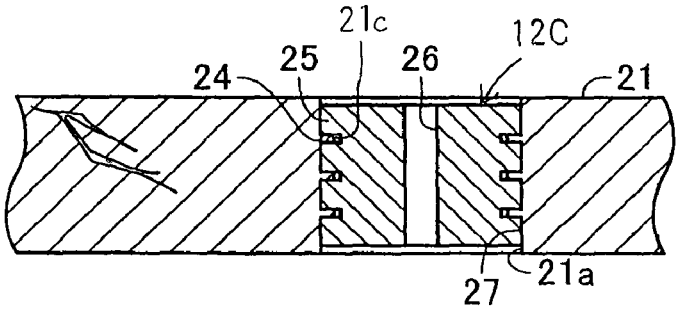
FIG. 16 is a cross sectional view taken along line D-D of FIG. 15 and showing the balance weight piece offset from grooves formed during the pressing work.

Subsequently, the worker inserts a tool such as a hexagonal wrench into the hexagonal hole 26, and turns the balance weight piece 12C about the center axis of the cylindrical hole 21*a* by 30 degrees. However, the worker does not turn the balance weight piece 12C over 60 degrees. While the worker is turning the balance weight piece 12C, the inner surface portion is further scrapped off with the corners 25, and circumferential grooves 27 are formed therein as shown in FIGS. 15 and 16. Thus, the corners 25 are offset from the grooves 21*b*, and the grooves 24 are filled with the wood. As a result, the balance weight piece 12C is clamped by the bar 21, and does not come loose.

The third modification 12C achieves all the advantages of the second modification 12B.

Figure 17:
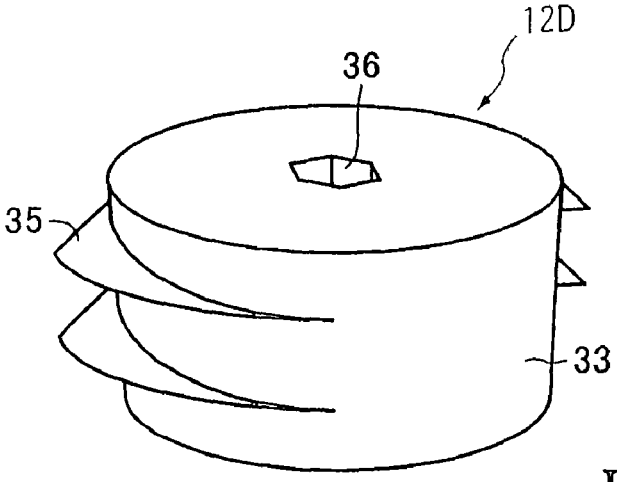
FIG. 17 is a perspective view showing the fourth modification of the balance weight piece.

FIG. 17 shows the fourth modification 12D. The balance weight piece 12D includes a center column 33 and two pairs of ridges 35 extending in parallel to the circumferential direction of the center column 33. A hexagonal hole 36 is formed in the center column 33, and extends in parallel to the centerline of the column 33. The two pairs of ridges 35 are on planes twisted with respect to the centerline of the column 33. In other words, the two pairs of ridges 35 are formed like a tooth of a bolt. One of the two pairs of ridges 35 is spaced from the other pair in the direction parallel to the centerline. The ridges 35 of each pair are spaced from one another in the circumferential direction by 180 degrees. Each of the ridges 35 has the maximum width at one end, and is gradually decreased toward the other end.

The balance weight piece 12D is embedded in a wood bar 31 of a key, which is similar to the black key 10*a* or white key 10*b*, as follows. The wood bar 31 is formed with an elliptical hole 31*a*, and the elliptical hole 31*a* is assigned to one of the balance weight pieces 12D.

Figure 18:
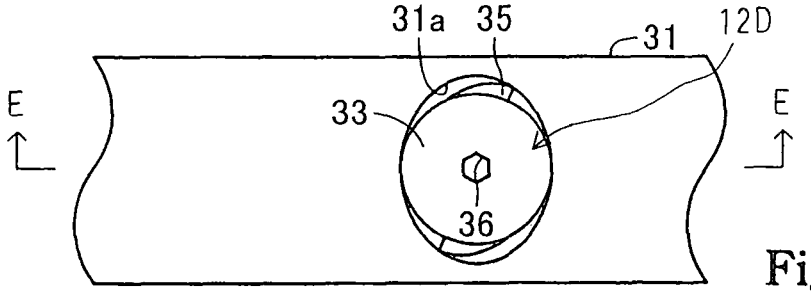
FIG. 18 is a side view showing the balance weight piece pressed into an elliptical hole formed in a bar.
Figure 19:
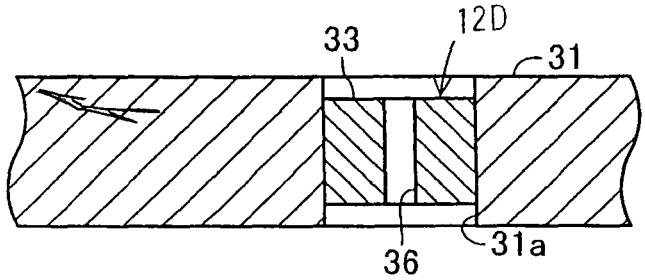
FIG. 19 is a cross sectional view taken along line E-E of FIG. 18 and showing the balance weight piece.

A worker roughly directs the balance weight piece 12D in such a manner that the maximum width is in parallel to the major diameter of the elliptical hole 31*a*, and presses the balance weight piece 12D into the elliptical hole 31*a* as shown in FIGS. 18 and 19. The worker may strike the balance weight piece 12D with a hammer. While the balance weigh piece 12D is advancing into the elliptical hole 31*a*, the inner surface portion, which defines the elliptical hole 31*a*, is partially scrapped off with the ridges 35, and two axial grooves are left in the inner surface portion.

Figure 20:
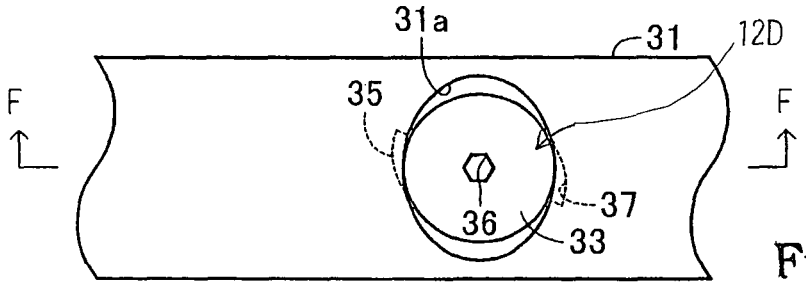
FIG. 20 is a side view showing the balance weight piece turned in the elliptical hole.
Figure 21:
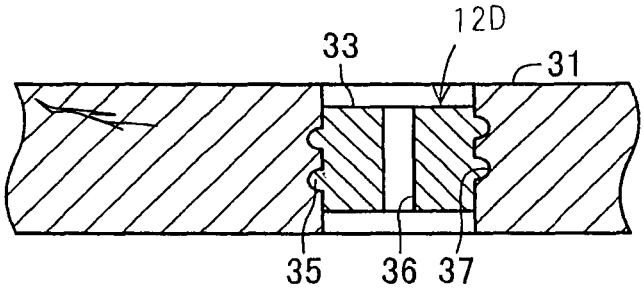
FIG. 21 is a cross sectional view taken along line F-F of FIG. 20 and showing the balance weight piece.

Subsequently, the worker inserts a hexagonal wrench into the hexagonal hole 36, and turns the balance weight piece 12D over 90 degrees. Then, the inner surface portion is further scraped off in the circumferential direction, and circumferential grooves 37 are formed in the inner surface portion. Thus, the ridges 35 are offset from the axial grooves along the circumferential direction so that the ridges 35 are pinched in the inner surface portion as shown in FIGS. 20 and 21. Thus, the fourth modification achieves all the advantages of the second modification. Moreover, since the two pairs of ridges 35 are twisted with respect to the centerline of the column 33, the worker moves the balance weight piece deep into the elliptical hole through the turning motion. Thus, the ridges 35 make the balance weight piece 12D hardly dropping out from the elliptical hole 31*a*.

Figure 22:
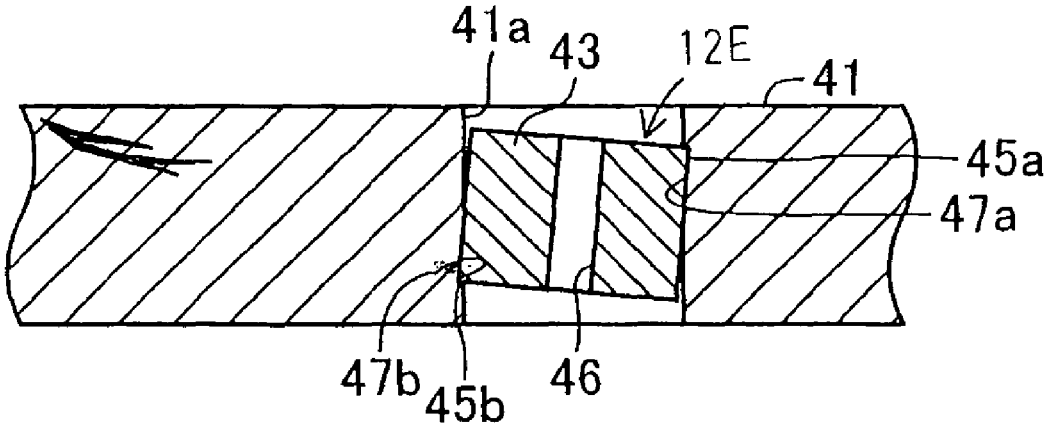
FIG. 22 is a cross sectional view showing the fifth modification of the balance weight piece.

FIG. 22 shows the fifth modification 12E. The balance weight piece 12E is made of copper, and is shaped in a column. A circular hole 46 is formed in the column in the direction of the centerline of the column. A wood bar 41 forms a part of a black/white key 10*a*/10*b*, and is formed with a circular hole 41*a*. The diameter of the circular hole 41*a* is slightly shorter than the diameter of the balance weight piece 12E.

The balance weight piece 12E is embedded in the bar 41 as follows. First, a worker presses the balance weight piece 12E into the circular hole 41*a*. Subsequently, the worker inserts a rod (not shown) from the opening on one of the end surfaces into the circular hole 46, and makes the rod project from the other end surface. The worker grasps both end portions of the rod with the hands, and inclines the rod with respect to the center axis of the circular hole 41*a*. Then, parts 45*a* and 45*b* of the circumferences of the end surfaces are lodged in the inner surface portion, which defines the circular hole 46, and form recesses 47*a* and 47*b* therein as shown in FIG. 22. Thus, the inner surface portion keeps the parts 45*a* and 45*b* of the circumferences in the recesses 47*a* and 47*b*. When force is unintentionally exerted on the balance weight piece 12E in the pressing direction, the part 45*b* of the circumference resists against the force. On the other hand, when the force is exerted in the direction of pulling out, the other part 45*a* resists against the force. For this reason, the balance weight piece 12E is hardly dropped off from the circular hole 41*a*.

The fifth modification achieves all the advantages of the second modification. Moreover, the balance weight piece 12E is simpler than the second to fourth modifications so that the production cost is lowered rather than the production cost of the second to fourth modifications.

Figure 23:
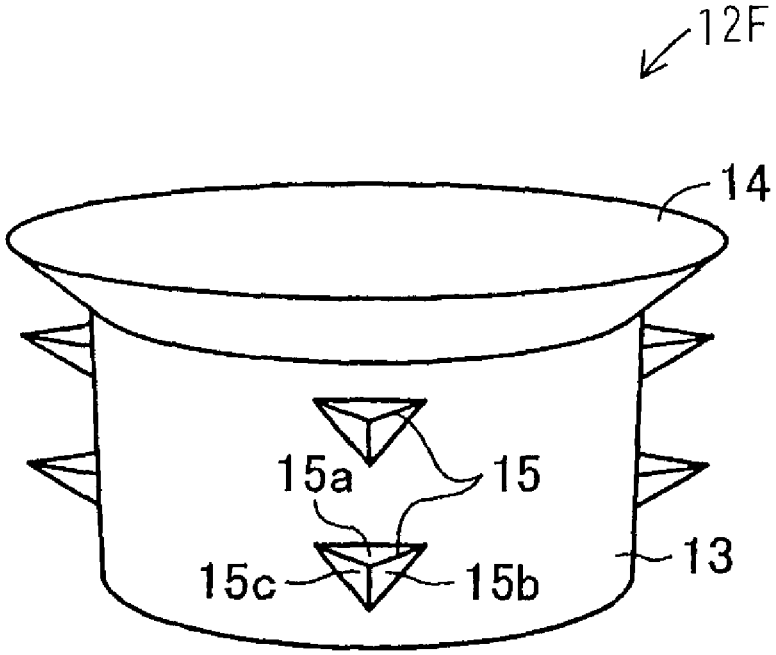
FIG. 23 is a perspective view showing the sixth modification of the balance weight piece.

FIG. 23 shows the sixth modification 12F. The balance weight piece 12F is similar in shape to the second modification 12B except that any hole is not formed therein. For this reason, parts and portions of the balance weight piece 12F are labeled with references designating corresponding parts and portions of the second modification 12B without detailed description.

The balance weight piece 12F is embedded into the bar 11 as follows. First, a worker presses the balance weight piece 12F into the bar 11 as similar to the balance weight piece 12B. Subsequently, the worker pinches the balance weight piece 12F with pliers, and turns the balance weight piece 12F. Then, the inner surface portion is scrapped off with the projections 15 in the circumferential direction, and circumferential grooves are left in the inner surface portion. Thus, the projections 15 are offset from the axial grooves so as to prevent the balance weight piece 12F from dropping off.

The balance weight piece 12F achieves all the advantages of the second modification. Since any hole is not required for the turning motion, the balance weight piece 12F is simpler than the balance weight piece 12B, and the production cost is lowered.

As will be understood from the foregoing description, the balance weight pieces 12 and 12A have the unit shapes 67 and 77, which are repeated more than seven times, and the unit shapes 67 and 77 are arranged at the pitches less than 2 millimeters. The seven times and pitches less than 2 millimeters are fallen within the range, which was confirmed by the present inventors through the experiments, so that the balance weight pieces 12 and 12A do not come loose. For this reason, the balance weight pieces 12 and 12A do not chatter in the holes of the black and white keys 10*a* and 10*b*, and are hardly dropped off.

The balance weight pieces 12 and 12A are further made offset from the axial grooves, which are formed during the insertion into the holes, as similar to the balance weight pieces 12B to 12F. The ridges 65, 75, projections 15 and corners 25 and 45*a*/45*b* are lodged in the inner surface portions defining the holes. As a result, the inner surface portions resist against the force in the direction of pulling-out as well as in the direction of further pressing into the holes, and prevent the balance weight pieces 12, 12A and 12B to 12F from dropping out.

Second Embodiment

Figure 24:
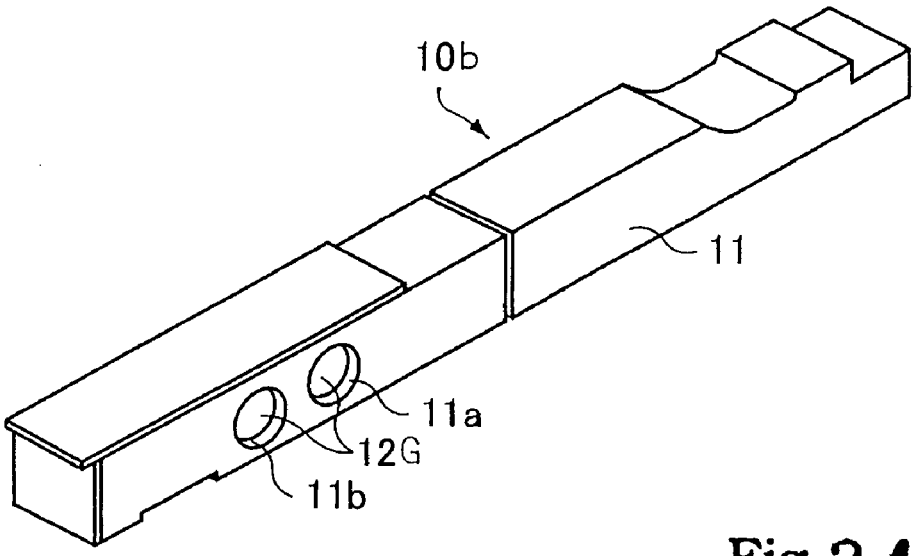
FIG. 24 is a perspective view showing a white key incorporated in another keyboard musical instrument of the present invention.
Figure 25:
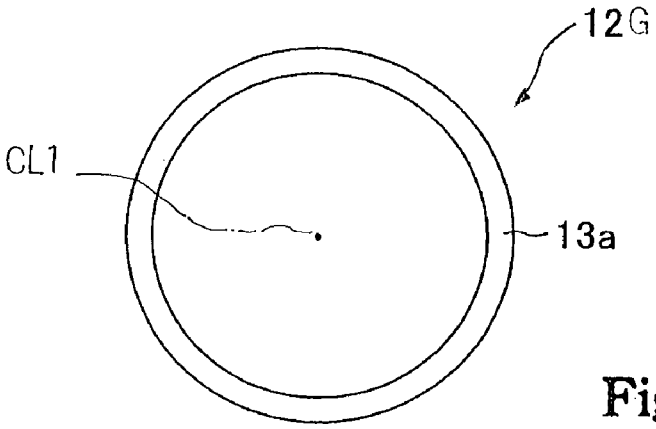
FIG. 25 is a front view showing an end surface of a balance weight piece embedded in the white key.
Figure 26:
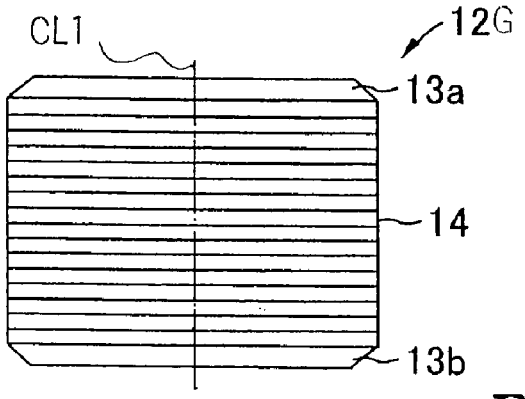
FIG. 26 is a side view showing a unit shape on the peripheral surface of the balance weight piece.

Referring to FIG. 24 of the drawings, balance weight pieces 12G are embedded in a wood bar 11 of a white key 10*b*, which forms a part of a keyboard together with other white keys 10*b* and black keys, and the keyboard is incorporated in another grand piano embodying the present invention. Since the grand piano implementing the second embodiment is similar in structure to the grand piano shown in FIG. 1, description is hereinafter focused on the balance weight pieces 12G for avoiding undesirable repetition.

The balance weight piece 12G is made of rigid material, which has the rigidity much larger in value than the material used for the bar 11, so as to give rise to elastic deformation in the material used for the bar 11. In this instance, the bar 11 is made of wood, and the balance weight piece 12G is made of iron.

Figure 27:
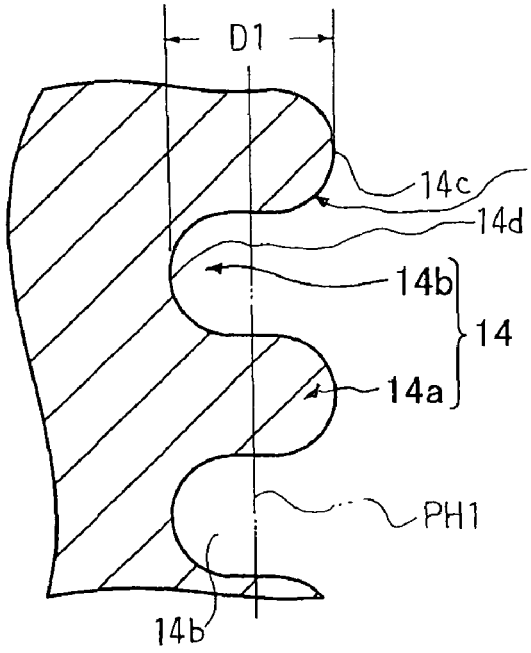
FIG. 27 is a cross sectional view showing the cross section of the unit shape repeated on the peripheral surface.

The balance weight piece 12G has a column-shape, and has a centerline CL1. Both end portions are tapered as indicated by references 13*a* and 13*b*, and a unit shape 14 is repeated on the peripheral surface between the tapered portions 13*a* and 13*b*. As shown in FIG. 27, the balance weight piece 12G is assumed to have a virtual peripheral surface PH1. The unit shape 14 includes a ridge 14*a* and a valley 14*b*. The peak 14*c* of each ridge 14*a* is rounded, and the bottom 14*d* of the valley 14*b* is defined by a rounded surface. In other words, the ridge 14*a* is a semi-circular ring, and the valley 14*b* is a semi-circular ring-shaped groove.

The unit patter 14 is repeated at pitches of 0.64 millimeter. In other words, the peak 14*c* of one of the ridges 14*a* is spaced from the peak 14*c* of the adjacent ridge 14*a* by 0.64 millimeter in the direction of the centerline CL1, and the bottom 14*d* of each valley 14*b* is spaced from the bottom 14*d* of the adjacent valley 14*b* also by 0.64 millimeter in the direction of the centerline CL1. As described hereinbefore, the ridge 14*a* has the semi-circular cross section, and the semi-circular cross section has the radius of curvature of 0.16 millimeter. Similarly, the valley 14*b* has the semi-circular cross section, and the semi-circular cross section has the radius of curvature of 0.16 millimeter. The distance D1 between the peak 14*c* and the bottom 14*d* is 0.32 millimeter. The unit shape 14 is repeated sixteen times between the tapered portions 13*a* and 13*b*. Thus, the repetition of the unit shape 14 is fallen within the range, i.e., equal to or greater than seven, and the pitches are further fallen within the range equal to or less than 2 millimeters.

The maximum diameter of the balance weight piece 12G is measured at the peaks 14*c* of the ridges 14*a*, and the inner diameter of the cylindrical holes 11*a* and 11*b* is shorter than the maximum diameter of the balance weight pieces 12G by 0.3 millimeter. Thus, the difference between the maximum diameter and the inner diameter is further fallen within the range equal to or less than 1 millimeter.

Figure 28:
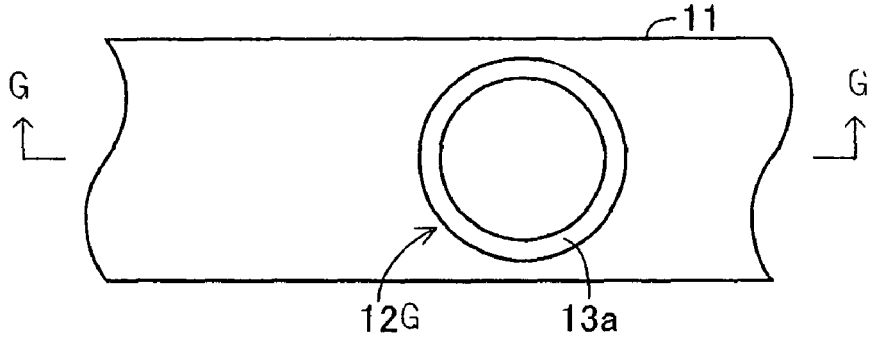
FIG. 28 is a side view showing the balance weight piece aligned with a hole formed in the white key.
Figure 29:
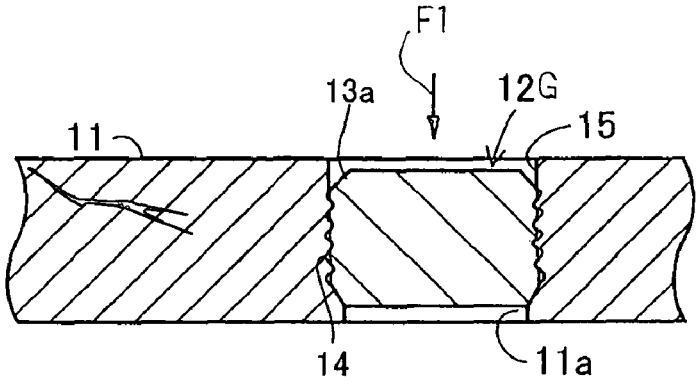
FIG. 29 is a cross sectional view taken along line G-G of FIG. 28 and showing the balance weight piece pressed into the white key.

The balance weight piece 12G is embedded in the wood bar 11 as follows. First, a worker aligns the centerline CL1 of the balance weight piece 12G with the center axis of the associated cylindrical hole 11*a* or 11*b* as shown in FIG. 28. Subsequently, the worker puts the balance weight piece 12G on a press machine (not shown), and exerts force F1 on the end surface of the balance weight piece 12G with a punch of the press machine as shown in FIG. 29. The balance weight piece 12G is pressed into the cylindrical hole 11*a* or 11*b*.

Figure 30:
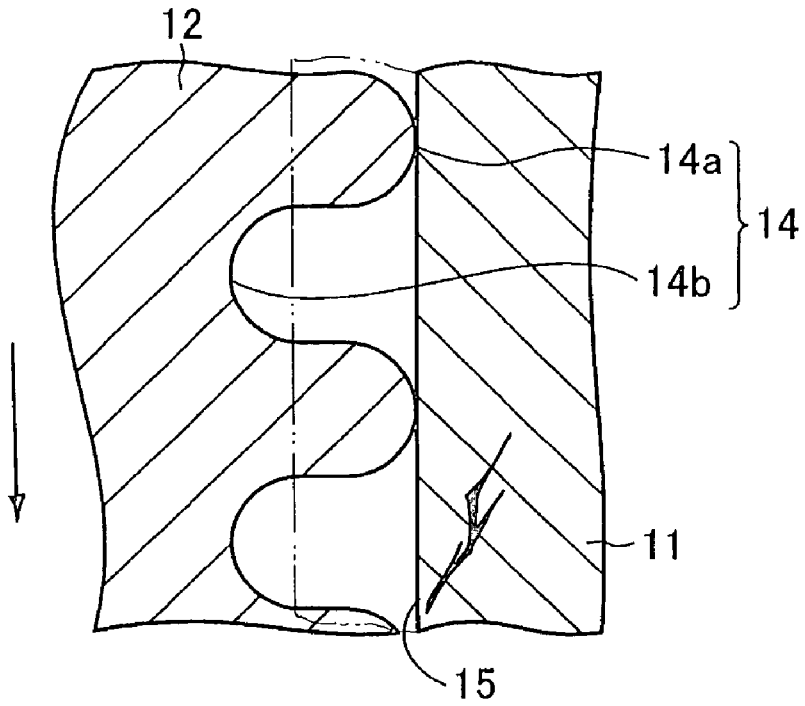
FIG. 30 is a cross sectional view showing the inner surface defining the hole during the insertion of the balance weight piece.

While the balance weight piece 12G is advancing into the cylindrical hole 11*a* or 11*b*, the ridges 14*a* give rise to elastic deformation in the inner surface portion, which defines the cylindrical hole 11*a* or 11*b*, as indicated by reference numeral 15 in FIG. 30. However, the inner surface portion is not scrapped off with the ridges 14*a*. This is because of the fact that the difference between the maximum diameter and the inner diameter is only 0.3 millimeter. Another reason why the inner surface portion is not scrapped off is that the ridges 14*a* are rounded.

Figure 31:
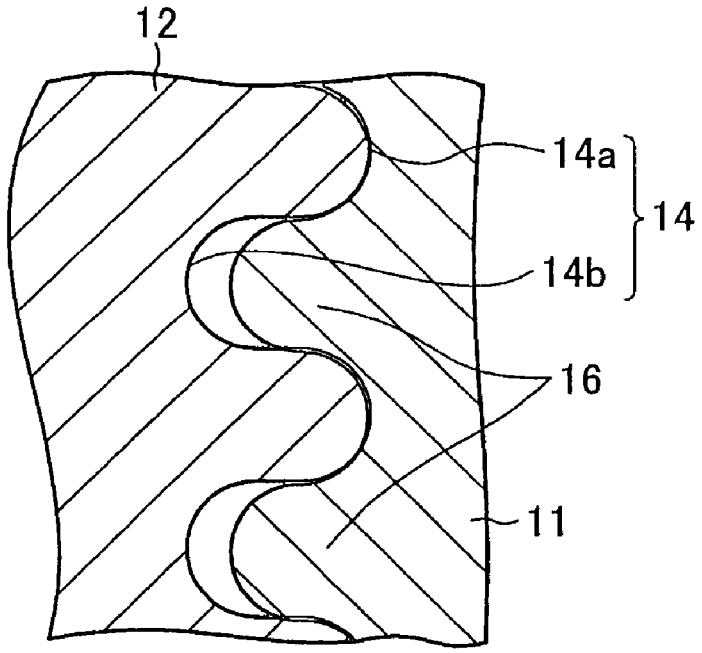
FIG. 31 is a cross sectional view showing the balance weight piece lodged in the inner surface portion.

When the balance weight piece 12G reaches the target position in the cylindrical hole 11*a* or 11*b*, the worker removes the force from the balance weight piece 12G. Then, the inner surface portion penetrates into the valleys 14*b* as indicated by reference numeral 16 in FIG. 31, and the ridges 14*a* are lodged in the inner surface portion. Moreover, the inner surface portion exerts the resilient force on the ridges 14*a* so that the ridges 14*a* are clamped. As a result, large friction takes place between the inner surface portion and the ridges 14*a* against the sliding motion of the balance weight piece 12G.

The present inventors confirmed the effect of the repeated unit shape 14 against external force exerted on balance weight pieces after being lodged in holes formed in wood bars. The present inventors prepared samples. One of the samples was identical with the balance weight piece 12G, was hereinafter referred to as "the first sample". The others of the samples were only different in the number of the unit shapes from the balance weight piece 12G, and were referred to as "the second sample" and "the third sample". Any unit shape was not formed on the peripheral surface of the second sample, and the unit shape was repeated on the peripheral surface of the third sample thirteen times.

The samples were respectively lodged in the inner surface portions of the wood bars through the method described hereinbefore. The present inventor defined reference force as critical resistance at which the inner surface portion of a key kept a balance weight piece therein against the external force exerted on the balance weight piece in the direction of the centerline during ordinary usage, i.e., in the environment where the temperature and humidity were regulated to 35 degrees in centigrade and 20 to 95%.

Figure 32:
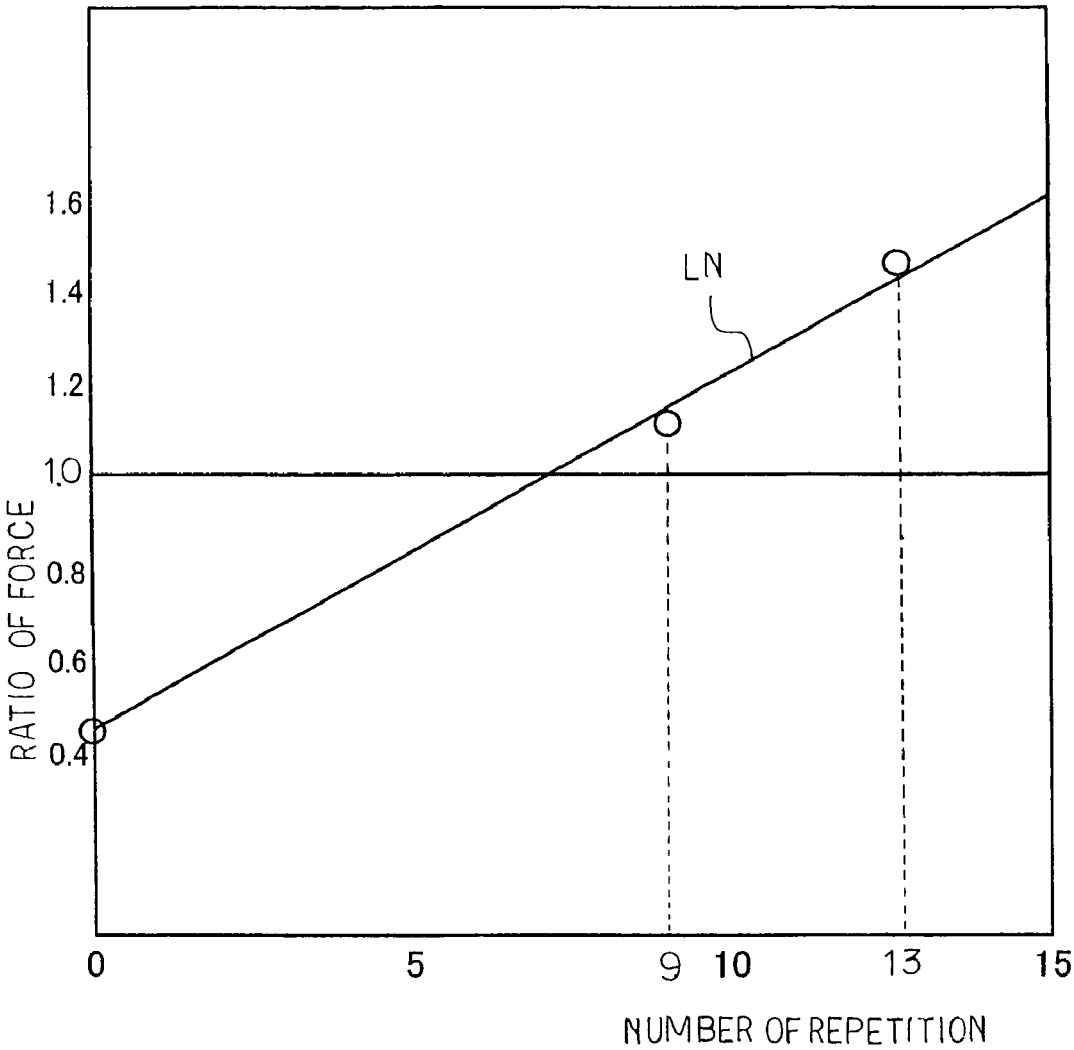
FIG. 32 is a graph showing relation between the number of repletion and a ratio of force to reference force.

The present inventors varied force exerted on the samples. The ratio of force to the reference force was indicated by the numerals on the axis of ordinate in FIG. 32. Although the second sample resisted the external force less than half of the reference force, the first sample and third sample withstood large external force. When the present inventors plotted the values of ratio of force in FIG. 32, the values were found on a linear line LN1, and the linear line LN1 crossed the reference force around 7. Thus, the present inventors concluded that the minimum number of repetition was seven.

Figure 33A:
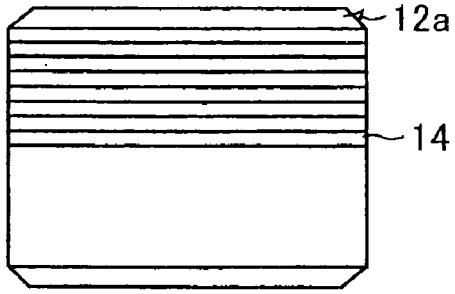
FIGS. 33A and 33B are side views showing samples of the balance weight piece differently formed with the unit shapes.
Figure 33B:
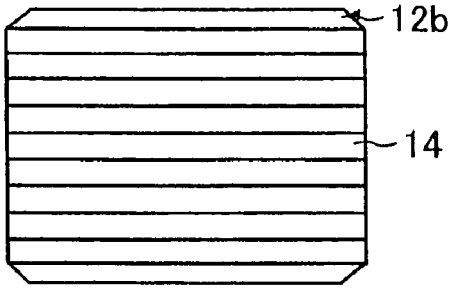

The present inventors further prepared samples of the balance weight piece. The fourth sample was formed with the unit shape 14 repeated eight times at the fine pitches in the direction of the centerline thereof, and the ridges 14*a* and valleys 14*b* were concentrated in one end portion close to one of the end surfaces as shown in FIG. 33A. On the other hand, the fifth sample was formed with the unit shape 14 also repeated eight times at the fine pitches, which were equal to those of the fourth sample, and the ridges 14*a* and valleys 14*b* occupied on the peripheral surface between both end surfaces as shown in FIG. 33B.

The present inventors lodged the fourth sample and fifth sample into the inner surface portion of the bars through the method described hereinbefore, and varied the external force exerted on the fourth sample and fifth sample. The fifth sample withstood the external force larger than that exerted on the fourth sample. However, both samples withstood the reference force. Thus, the location of the ridges 4*a* and valleys 4*b* did not have serious influence on the resistance against the external force.

Figure 34A:
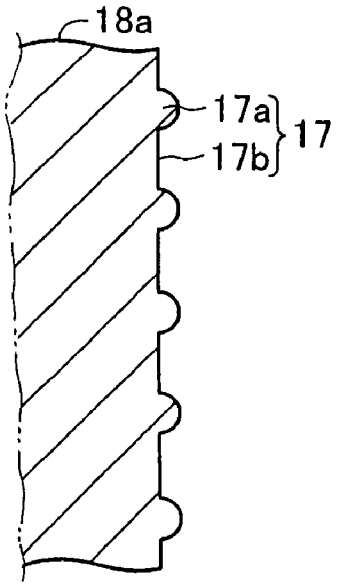
FIGS. 34A and 34B are cross sectional views showing other samples different in ratio between the width of ridges and the width of valleys from one another.
Figure 34B:
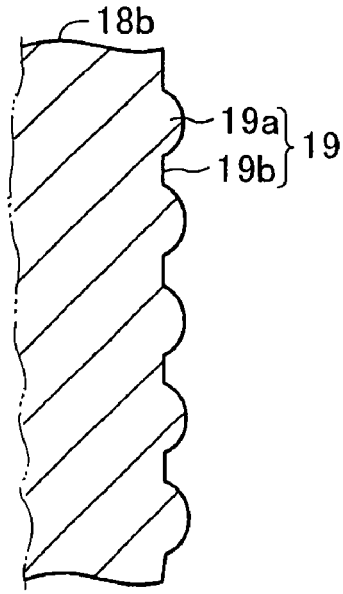

The present inventors further prepared two samples, i.e., the sixth sample and seventh sample. The sixth sample was formed with a unit shape 17 at predetermined pitches, and the seventh sample was formed with a unit shape 19 at pitches equal to the predetermined pitches of the unit shape 17. A narrow ridge 17*a* and a wide valley 17*b* formed in combination the unit shape 17 as shown in FIG. 34A, and the width of the narrow ridge 17*a* and the width of the wide valley 17*b* were adjusted to 3:7 on a virtual plane passing through the mid point between the peak of the ridge 17*a* and the bottom of the valley 17*b*. On the other hand, a wide ridge 19*a* and a narrow valley 19*b* formed in combination the unit shape 19 as shown in FIG. 34B, and the width of the wide ridge 19*a* and the width of the narrow valley 19*b* were adjusted to 7:3 on a virtual plane passing through the mid point between the peak of the ridge 19*a* and the bottom of the valley 19*b*.

The present inventors lodged the sixth sample and seventh sample in inner surface portions of wood bars defining holes, and determined external force against which the sixth sample and seventh sample withstood. The seventh sample withstood the force larger than the force exerted on the sixth sample. However, both samples withstood the reference force in so far as the number of repetition and pitches were fallen within the ranges of the present invention.

The present inventors further prepared samples different in ratio between the width of ridges and width of valleys, and sought the critical ratio. The present inventors determines the minimum ratio between the width of the ridges and the width of valleys at 3:10. When the ratio was lower than 30%, the sample could not withstand force less than the reference force. On the other hand, when the width of valleys 19*b* was narrower than 1 millimeter, the samples could not withstand the reference force.

As will be understood from the foregoing description, the balance weight piece 12G is made of the material having the rigidity larger than the material for the bar 11, and the unit shape is repeated on the peripheral surface of the balance weight piece 12G plural times, i.e., equal to or more than seven times at the fine pitches, i.e., equal to or less than 2 millimeters. The balance weight piece 12G is resiliently lodged in the inner surface portion, which defines the hole 11*a*/11*b*, without scrapping off the inner surface portion by virtue of the fine pitches. The rounded ridges 14*a* are conducive to the insertion without scrapping off the inner surface portion.

Modifications of the Second Embodiment

Figure 35:
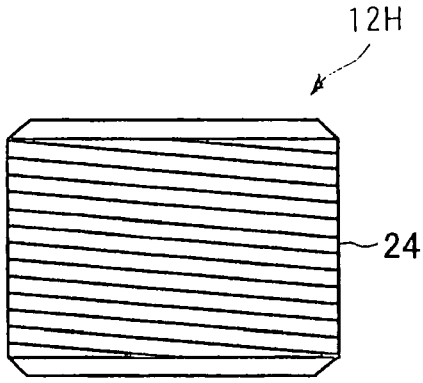
FIG. 35 is a side view showing the first modification of the balance weight piece shown in FIGS. 25 and 26.

FIG. 35 shows the first modification 12H of the second embodiment. The balance weight piece 12H has a column shape, and a unit shape 24 is repeated on the peripheral surface of the column. The ridge 14*a* and valley 14*b* form in combination the unit shape 24 as similar to the unit shape 14. However, the ridges 14*a* are merged with one another like a single spiral. Namely, the ridges 14*a* obliquely extend with respect to the centerline of the column. Accordingly, the valleys 14*b* are continued. The unit shape 24 is a part of the spiral wound by 360 degrees, and the pitches, cross section, difference between the maximum diameter and the inner diameter and depth are equal to those of the unit shape 14. The unit shape 24 is repeated more than 7 times.

The balance weight piece 12H achieves all the advantages of the balance weight piece 12G. Moreover, the obliquely arranged ridges 14*a* generate thrust in the direction of the centerline of the column so that a worker easily inserts the balance weight piece 12H into a hole without scraping.

Figure 36:
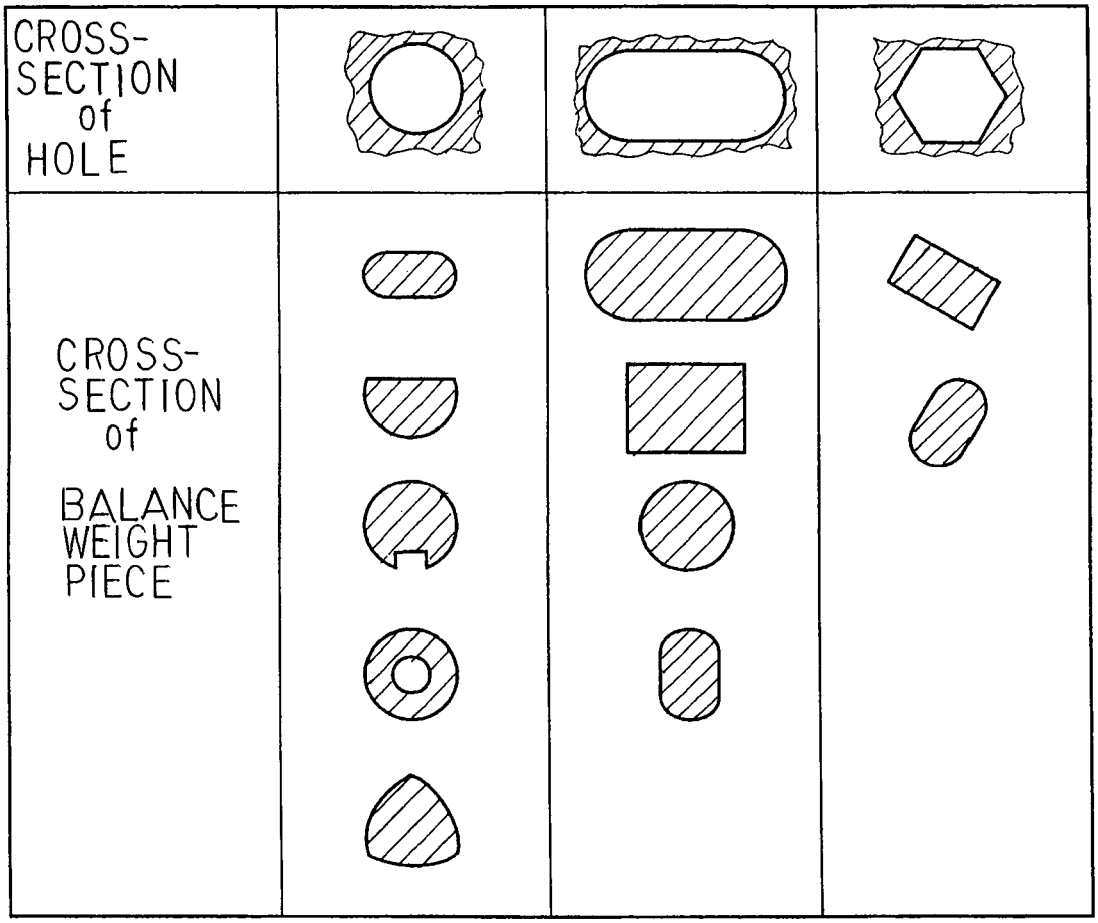
FIG. 36 is a view showing combinations between holes/recesses and the other modifications.

The other modifications have different cross sections. FIG. 36 shows combinations between the cross sections of holes or cross sections of recesses and the cross sections of the other modifications. There are three columns in FIG. 36.

The leftmost column shows the combination between the hole/recess with a circular cross section and five balance weight pieces different in cross section from one another. The five balance weight pieces have an elongated circular cross section, a semi-circular cross section, a circular cross section formed with a notch, a cylindrical cross section and a cross section encircled with three arcs, respectively.

The rightmost column shows the combination between the hole/recess with a hexagonal cross section and two balance weight pieces different in cross section from one another. The two balance weight pieces have a rectangular cross section and an elongated circular cross section, respectively.

The center column shows the combinations between the hole/recess with an elongated circular cross section and four balance weight pieces different in cross section from one another. The four balance weight pieces have an elongated circular cross section, a square cross section, a circular cross section and a small elongated circular cross section, respectively.

Even though several combinations are different in area between the hole/recess and the balance weight pieces, at least part of the peripheral surfaces are to be collision with the inner surface portions defining the recesses/holes, and the repletion of the unit shape makes the inner surface portions elastically deformed during the insertion into the holes/recesses.

Although particular embodiments of the present invention have been shown and described, it will be apparent to those skilled in the art that various changes and modifications may be made without departing from the spirit and scope of the present invention.

The present invention may appertain to other movable component parts such as, for example, the action unit 2, hammers 3, damper levers, which form parts of the dampers 5, and pedal system 6. The balance weight pieces may be embedded in those movable component parts in order to regulate the weight to target values.

The second modification to sixth modification 12B to 12F of the balance weight piece 12 may have the unit shape repeated seven times or more at fine pitches equal to or less than 2 millimeters. These further modifications are stable in the holes without turning them in the holes.

Yet another modification of the balance weight piece 12 may have semi-spherical projections arranged in at least one queue along the center axis of a center column. The semi-spherical projections in each queue are spaced from one another by fine pitches equal to or less than 2 millimeters, and the number of semi-spherical projections in each queue is at least seven.

Still another modification of the balance weight piece 12 may not be formed with any through-holes. A worker turns the still another modification with a suitable tool such as the pliers or pinch.

The parts 45*a* and 45*b* may project from the circumferences in still another modification of the balance weight piece 12.

Any hole is not formed in the second to fifth modifications 12B, 12C, 12D and 12E. A worker pinches the balance weight pieces with the pliers for the motion after the insertion. A vacuum cups or a pinch is available for the motion after the insertion.

The balance weight pieces 12B to 12F may have the diameter slightly shorter than the diameter of the holes. After the insertion, the projections or ridges are lodged into the inner surface portions by pressing them onto the parts of the inner surface portions.

The holes, which are formed in the bars, may have triangular cross sections, rectangular cross sections, hexagonal cross section, polygonal cross sections or combinations of these cross sections.

The holes 11*a*/11*b*, 21*a*, 31*a* and 41*a* may be replaced with recesses open on either side surfaces.

The balance weight pieces 12, 12A, 12B to 12F may be embedded in another sort of parts of a musical instrument. Weight pieces are, by way of example, embedded in damper levers of a piano. The weight pieces may be replaced with the balance weight pieces 12, 12A to 12F.

Valleys may have cross sections different from the semi-circular cross section. Since the valleys are only expected to permit the inner surface portion elastically to penetrate thereinto, a pair of flat surfaces may form each of the valleys.

The cross section shown in FIG. 36 does not set any limit to the technical scope of the present invention. A hole or recess may have a cross section corresponding to the cross section of the balance weight piece shown in FIG. 36. A hole/recess and a balance weight piece may have elliptical cross sections or polygonal cross sections.

The grand piano does not set any limit to the technical scope of the present invention. The balance weight pieces are required for an upright piano, a hybrid keyboard musical instrument such as, for example, an automatic player keyboard musical instrument and a mute piano, an electronic keyboard musical instrument, a bow for a stringed musical instrument and percussion musical instruments.

The weight pieces 12 and 12A to 12H may not partially cancel the load. In other words, the weight pieces may be expected to increase the total weight of a movable part.

The ridges and valleys do not set any limit to the technical scope of the present invention. A unit shape may be formed by plural bumps arranged on a circle line or a helical line at intervals.

The component parts or portions thereof in the embodiments and modifications are correlated with claim languages as follows.

The black and white keys 10*a* and 10*b* serve as a "body", and the wood bars 11 offer an "elastically deformable inner surface portion". The balance weight piece 12, 12A, 12G and 12H serve as a "weight piece". Each of the holes 11*a*, 11*b* is corresponding to "at least one hollow space", and the valleys 14*b* as a whole constitute "clearance".

The black and white keys 10*a*/10*b*, component parts of the action units 2, hammers 3, strings 4 and component parts of the dampers 5 are corresponding to "plural component parts", and each of the black and white keys 10*a*/10*b* serves as "at least one of said component parts".

What is claimed is:

1. A movable part of a musical instrument, comprising:

a body formed with at least one elliptical hollow space defined by an elastically deformable inner surface portion;

at least one weight piece non-rotationally inserted into said hollow space in an insertion direction; and a plurality of projections formed in a circumferential direction on an outer surface of said at least one weight piece, said projections being ridges projecting from said outer surface in a direction perpendicular to said insertion direction and formed at a pitch equal to or less than 2 millimeters, said projections defining spaces therebetween, wherein after said at least one weight piece is inserted into said hollow space it is rotated such that said plurality of projections penetrate said elastically deformable inner surface portion.

2. The movable part as set forth in claim 1, in which said spaces between said ridges form valleys.

3. The movable part as set forth in claim 2, in which the ridge of one of said projections is spaced from the ridge of another projection adjacent thereto by said valley.

4. The movable part as set forth in claim 2, in which the ridge of one of said projections is continued to the ridge of another projection adjacent thereto so that all the ridges form a spiral ridge.

5. The movable part as set forth in claim 2, in which said ridge has a width falling within a range between 30% of a corresponding width of said valley and 100% of said corresponding width.

6. The movable part as set forth in claim 5, in which said corresponding width of said valley is equal to or less than 1 millimeter.

7. The movable part as set forth in claim 5, wherein a cross section of said weight piece is selected from the group consisting of a circle, an ellipse, an elongated circle, a semicircle, a circle formed with a notch, a ring, a rectangle and a hexagon.

8. The movable part as set forth in claim 1, in which a cross section of said weight piece with said projections has a distance longer than a corresponding distance on a cross section of said hollow space.

9. The movable part as set forth in claim 1, in which a depth of said spaces between said projections is equal to or greater than 0.2 millimeter.

10. A musical instrument comprising:

plural component parts for producing sound;

at least one of said plural component parts being movable in a sequence to produce said sound, wherein said at least one of said plural component parts including:

a body formed with at least one elliptical hollow space defined by an elastically deformable inner surface portion, and at least one weight piece formed with a plurality of projections formed in a circumferential direction on an outer surface of said at least one weight piece, said projections being ridges projecting from said outer surface in a direction perpendicular to said insertion direction and formed at a pitch equal to or less than 2 millimeters, wherein said at least one weight piece is non-rotationally inserted into said hollow space to a final insertion depth and then rotated so as to permit said plurality of projections to penetrate said elastically deformable inner surface portion.

11. The musical instrument as set forth in claim 10, in which said at least one of said plural component parts is a key forming a part of a keyboard.

12. The musical instrument as set forth in claim 10, in which said spaces are valleys.

13. The musical instrument as set forth in claim 12, in which a cross section of said weight piece with said projections has a maximum distance longer than a corresponding distance on a cross section of said hollow space by a predetermined value fallen within a range from 0.2 millimeter to 1.0 millimeter.

14. A method of assembling a weight piece in a movable part of a musical instrument, comprising:

a) preparing a body formed with at least one hollow space defined by an elastically deformable inner surface portion and at least one weight piece having at least seven projections formed in a circumferential direction on an outer surface of said at least one weight piece, said projections being ridges projecting from said outer surface in a direction perpendicular to an insertion direction and formed at a pitch equal to or less than 2 millimeters, at least one of said ridges having a rounded top, said projections defining spaces therebetween, at least one of said spaces forming a valley between adjacent ones of said ridges in said direction of insertion;

b) non-rotationally inserting in the insertion direction said at least one weight piece into said at least one hollow space to a final depth so as to make said inner surface portion elastically deformed by said projections; and c) rotating said at least one weight piece about an axis of said insertion direction, said rotation being less than 180 degrees.

15. The method as set forth in claim 14, in which a cross section of said weight piece with said projections has a maximum distance longer than a corresponding distance on a cross section of said hollow space by a predetermined value falling within a range from 0.2 millimeter to 1.0 millimeter.

16. A movable part of a musical instrument comprising:

a body formed with at least one hollow space defined by an elastically deformable inner surface portion;

at least one weight piece inserted into said hollow space to a final insertion depth in an insertion direction, wherein said weight piece is rotated about an axis parallel to the insertion direction after it has reached said final insertion depth to dispose said weight piece in a final position in said body; and a plurality of projections formed in at least two rows that extend in a circumferential direction on an outer surface of said at least one weight piece, said projections projecting from said outer surface in a direction perpendicular to said insertion direction, wherein said plurality of projections engage said elastically deformable inner surface portion, at least one first groove being formed in said elastically deformable inner surface portion in parallel to said insertion direction, at least one second groove being formed in said elastically deformable inner surface portion in a direction circumferential to said at least one hollow space, whereby at least one of said plurality of projections is offset from said at least one first groove by less than 180 degrees.

17. A musical instrument comprising:

plural component parts for producing sound;

at least one of said plural component parts being movable in a sequence to produce said sound, wherein said at least one of said plural component parts including:

a body formed with at least one elliptical hollow space defined by an elastically deformable inner surface portion, and at least one weight piece having a plurality of projections formed in at least two rows that extend in a circumferential direction on an outer surface of said at least one weight piece, said projections projecting from said outer surface in a direction perpendicular to an insertion direction, wherein said at least one weight piece is non-rotationally inserted into said hollow space in an axial direction so as to cause said elastically deformable inner surface portion elastically to penetrate into spaces among said plurality of projections, whereby said plurality of projections engage elastically deformable inner surface portion, wherein said at least one weight piece is rotated about an axis parallel to said insertion direction after it has reached a final insertion depth in said hollow space so as to keep said plurality of projections engaging with said elastically deformable inner surface portion, said rotation being less than 180 degrees.

18. A method of assembling a weight piece in a movable part of a musical instrument, comprising:

a) preparing a body formed with at least one hollow space defined by an elastically deformable inner surface portion, the at least one hollow space having an axis;

b) preparing at least one weight piece having a plurality of projections formed in at least two rows that extend in a circumferential direction on an outer surface of said at least one weight piece;

c) non-rotationally inserting said at least one weight piece into said at least one hollow space in a direction parallel to said axis so as to cause said elastically deformable inner surface portion elastically to penetrate into spaces among said plurality of projections, whereby said plurality of projections engage elastically deformable inner surface portion;

d) stopping said insertion of said at least one weight piece at a final depth in said at least one hollow space; and e) rotating said at least one weight piece about said axis at said certain position so as to keep said plurality of projections engaging with said elastically deformable inner surface portion, said rotation being less than 180 degrees.

* * * * *